United States Patent [19]

Newkirk et al.

[11] Patent Number: 5,040,588

[45] Date of Patent: Aug. 20, 1991

[54] METHODS FOR FORMING MACROCOMPOSITE BODIES AND MACROCOMPOSITE BODIES PRODUCED THEREBY

[75] Inventors: Marc S. Newkirk, Newark, Del.; Danny R. White, Elkton, Md.; Christopher R. Kennedy, Newark; Alan S. Nagelberg, Wilmington, both of Del.; Michael K. Aghajanian, Bel Air, Md.; Robert J. Wiener, Newark, Del.

[73] Assignee: Lanxide Technology Company, LP, Newark, Del.

[21] Appl. No.: 269,464

[22] Filed: Nov. 10, 1988

[51] Int. Cl.[5] ..... B22D 19/14

[52] U.S. Cl. ..... 164/97; 164/101

[58] Field of Search ..... 164/97, 98, 100, 101, 164/102, 103, 104, 91

[56] References Cited

U.S. PATENT DOCUMENTS

| | | | |
|---|---|---|---|
| 2,951,771 | 9/1960 | Butler | 117/114 |
| 3,031,340 | 4/1962 | Girardot | 117/118 |
| 3,149,409 | 9/1964 | Maruhn | 29/156.5 |
| 3,364,976 | 1/1968 | Reding et al. | 164/63 |
| 3,396,777 | 8/1968 | Reding, Jr. | 164/97 |
| 3,547,180 | 12/1970 | Cochran et al. | 164/61 |
| 3,608,170 | 9/1971 | Larson et al. | 29/149.5 |
| 3,718,441 | 2/1973 | Landingham | 29/182.1 |
| 3,864,154 | 2/1975 | Gazza et al. | 264/60 X |
| 3,868,267 | 2/1975 | Gazza et al. | 264/60 X |
| 3,915,699 | 10/1975 | Umehara et al. | 419/17 |
| 3,969,553 | 7/1976 | Kondo et al. | 427/299 |

(List continued on next page.)

FOREIGN PATENT DOCUMENTS

| | | | |
|---|---|---|---|
| 0094353 | 11/1983 | European Pat. Off. . | |
| 0115742 | 8/1984 | European Pat. Off. . | |
| 0340957 | 11/1989 | European Pat. Off. . | |
| 0364963 | 4/1990 | European Pat. Off. . | |
| 2819076 | 10/1979 | Fed. Rep. of Germany . | |
| 144441 | 8/1983 | Japan . | |
| 2156718 | 10/1985 | United Kingdom | 164/102 |

OTHER PUBLICATIONS

F. Delannay, L. Froyen, and A. Deruyttere, "Review: The Wetting of Solids by Molten Metals and Its Relation to the Preparation of Metal-Matrix Composites", Journal of Materials Science, vol. 22, No. 1, pp. 1-16, Jan. 1987.

A. Mortensen, M. N. Gungor, J. A. Cornie, and M. C. Flemings, "Alloy Microstructures in Cast Metal Matrix Composites", Journal of Metals, vol. 38, No. 3, pp. 30-35, Mar. 1986.

G. R. Edwards and D. L. Olson, "The Infiltration Kinetics of Aluminum in Silicon Carbide Compacts", Annual Report from Center for Welding Research, Colorado School of Mines, under ONR Contract No. M00014-85-0451, DTIC Report AD-A184 682, Jul. 1987.

(List continued on next page.)

*Primary Examiner*—Richard K. Seidel

*Attorney, Agent, or Firm*—Mark G. Mortenson; William E. McShane; Michael K. Boyer

[57] ABSTRACT

The present invention relates to the formation of a macrocomposite body by spontaneously infiltrating a permeable mass of filler material or a preform with molten matrix metal and bonding the spontaneously infiltrated material to at least one second material such as a ceramic or ceramic containing body and/or a metal or metal containing body. Particularly, an infiltration enhancer and/or infiltration enhancer precursor and/or infiltrating atmosphere are in communication with a filler material or a preform, at least at some point during the process, which permits molten matrix metal to spontaneously infiltrate the filler material or preform. Moreover, prior to infiltration, the filler material or preform is placed into contact with at least a portion of a second material such that after infiltration of the filler material or preform, the infiltrated material is bonded to the second material, thereby forming a macrocomposite body.

38 Claims, 3 Drawing Sheets

U.S. PATENT DOCUMENTS

| | | | |
|---|---|---|---|
| 3,970,136 | 7/1976 | Cannell et al. | 164/108 |
| 4,082,864 | 4/1978 | Kendall et al. | 427/248 |
| 4,232,091 | 11/1980 | Grimshaw et al. | 428/472 |
| 4,376,803 | 3/1983 | Katzman | 428/408 |
| 4,376,804 | 3/1983 | Katzman | 428/408 |
| 4,404,262 | 9/1983 | Watmough | 428/539.5 |
| 4,450,207 | 5/1984 | Donomoto et al. | 428/614 |
| 4,473,103 | 9/1984 | Kenney et al. | 164/97 |
| 4,559,246 | 12/1985 | Jones | 427/299 |
| 4,570,316 | 2/1987 | Sakamaki et al. | 29/156.8 R |
| 4,587,177 | 5/1986 | Toaz et al. | 428/614 |
| 4,630,665 | 12/1986 | Novak | 164/97 |
| 4,657,065 | 4/1987 | Wada et al. | 164/461 |
| 4,662,429 | 5/1987 | Wada et al. | 164/461 |
| 4,673,435 | 6/1987 | Yamaguchi et al. | 74/235 |
| 4,677,901 | 7/1987 | Ban et al. | 92/213 |
| 4,679,493 | 7/1987 | Munro et al. | 92/212 |
| 4,713,111 | 12/1987 | Cameron et al. | 75/68 R |
| 4,731,298 | 3/1988 | Shindo et al. | 428/611 |
| 4,753,690 | 6/1988 | Wada et al. | 148/11.5 A |
| 4,802,524 | 2/1989 | Donomoto | 164/97 |
| 4,828,008 | 5/1985 | White et al. | 164/66.1 |
| 4,871,008 | 10/1989 | Dwivedi et al. | 164/6 |
| 4,932,099 | 6/1990 | Corwin | 164/97 |

METHODS FOR FORMING MACROCOMPOSITE BODIES AND MACROCOMPOSITE BODIES PRODUCED THEREBY

FIELD OF THE INVENTION

The present invention relates to the formation of a macrocomposite body by spontaneously infiltrating a permeable mass of filler material or a preform with molten matrix metal and bonding the spontaneously infiltrated material to at least one second material such as a ceramic and/or a metal. Particularly, an infiltration enhancer and/or infiltration enhancer precursor and/or infiltrating atmosphere are in communication with a filler material or a preform, at least at some point during the process, which permits molten matrix metal to spontaneously infiltrate the filler material or preform. Moreover, prior to infiltration, the filler material or preform is placed into contact with at least a portion of a second material such that after infiltation of the filler material or preform, the infiltrated material is bonded to the second material, thereby forming a macrocomposite body.

BACKGROUND OF THE INVENTION

Composite products comprising a metal matrix and a strengthening or reinforcing phase such as ceramic particulates, whiskers, fibers or the like, show great promise for a variety of applications because they combine some of the stiffness and wear resistance of the reinforcing phase with the ductility and toughness of the metal matrix. Generally, a metal matrix composite will show an improvement in such properties as strength, stiffness, contact wear resistance, and elevated temperature strength retention relative to the matrix metal in monolithic form, but the degree to which any given property may be improved depends largely on the specific constituents, their volume or weight fraction, and how they are processed in forming the composite. In some instances, the composite also may be lighter in weight than the matrix metal per se. Aluminum matrix composites reinforced with ceramics such as silicon carbide in particulate, platelet, or whisker form, for example, are of interest because of their higher stiffness, wear resistance and high temperature strength relative to aluminum.

Various metallurgical processes have been described for the fabrication of aluminum matrix composites, including methods based on powder metallurgy techniques and liquid-metal infiltration techniques which make use of pressure casting, vacuum casting, stirring, and wetting agents. With powder metallurgy techniques, the metal in the form of a powder and the reinforcing material in the form of a powder, whiskers, chopped fibers, etc., are admixed and then either cold-pressed and sintered, or hot-pressed. The maximum ceramic volume fraction in silicon carbide reinforced aluminum matrix composites produced by this method has been reported to be about 25 volume percent in the case of whiskers, and about 40 volume percent in the case of particulates.

The production of metal matrix composites by powder metallurgy techniques utilizing conventional processes imposes certain limitations with respect to the characteristics of the products attainable. The volume fraction of the ceramic phase in the composite is limited typically, in the case of particulates, to about 40 percent. Also, the pressing operation poses a limit on the practical size attainable. Only relatively simple product shapes are possible without subsequent processing (e.g., forming or machining) or without resorting to complex presses. Also, nonuniform shrinkage during sintering can occur, as well as nonuniformity of microstructure due to segregation in the compacts and grain growth.

U.S. Pat. No. 3,970,136, granted July 20, 1976, to J. C. Cannell et al., describes a process for forming a metal matrix composite incorporating a fibrous reinforcement, e.g. silicon carbide or alumina whiskers, having a predetermined pattern of fiber orientation. The composite is made by placing parallel mats or felts of coplanar fibers in a mold with a reservoir of molten matrix metal, e.g., aluminum, between at least some of the mats, and applying pressure to force molten metal to penetrate the mats and surround the oriented fibers. Molten metal may be poured onto the stack of mats while being forced under pressure to flow between the mats. Loadings of up to about 50% by volume of reinforcing fibers in the composite have been reported.

The above-described infiltration process, in view of its dependence on outside pressure to force the molten matrix metal through the stack of fibrous mats, is subject to the vagaries of pressure-induced flow processes, i.e., possible non-uniformity of matrix formation, porosity, etc. Non-uniformity of properties is possible even though molten metal may be introduced at a multiplicity of sites within the fibrous array. Consequently, complicated mat/reservoir arrays and flow pathways need to be provided to achieve adequate and uniform penetration of the stack of fiber mats. Also, the aforesaid pressure-infiltration method allows for only a relatively low reinforcement to matrix volume fraction to be achieved because of the difficulty inherent in infiltrating a large mat volume. Still further, molds are required to contain the molten metal under pressure, which adds to the expense of the process. Finally, the aforesaid process, limited to infiltrating aligned particles or fibers, is not directed to formation of aluminum metal matrix composites reinforced with materials in the form of randomly oriented particles, whiskers or fibers.

In the fabrication of aluminum matrix-alumina filled composites, aluminum does not readily wet alumina, thereby making it difficult to form a coherent product. Various solutions to this problem have been suggested. One such approach is to coat the alumina with a metal (e.g., nickel or tungsten), which is then hot-pressed along with the aluminum. In another technique, the aluminum is alloyed with lithium, and the alumina may be coated with silica. However, these composites exhibit variations in properties, or the coatings can degrade the filler, or the matrix contains lithium which can affect the matrix properties.

U.S. Pat. No. 4,232,091 to R. W. Grimshaw et al., overcomes certain difficulties in the art which are encountered in the production of aluminum matrix-alumina composites. This patent describes applying pressures of 75–375 kg/cm$^2$ to force molten aluminum (or molten aluminum alloy) into a fibrous or whisker mat of alumina which has been preheated to 700° to 1050° C. The maximum volume ratio of alumina to metal in the resulting solid casting was 0.25/1. Because of its dependency on outside force to accomplish infiltration, this process is subject to many of the same deficiencies as that of Cannell et al.

European Patent Application Publication No. 115,742 describes making aluminum-alumina composites, especially useful as electrolytic cell components, by filling the voids of a preformed alumina matrix with molten aluminum. The application emphasizes the non-wettability of alumina by aluminum, and therefore various techniques are employed to wet the alumina throughout the preform. For example, the alumina is coated with a wetting agent of a diboride of titanium, zirconium, hafnium, or niobium, or with a metal, i.e., lithium, magnesium, calcium, titanium, chromium, iron, cobalt, nickel, zirconium, or hafnium. Inert atmospheres, such as argon, are employed to facilitate wetting. This reference also shows applying pressure to cause molten aluminum to penetrate an uncoated matrix. In this aspect, infiltration is accomplished by evacuating the pores and then applying pressure to the molten aluminum in an inert atmosphere, e.g., argon. Alternatively, the preform can be infiltrated by vapor-phase aluminum deposition to wet the surface prior to filling the voids by infiltration with molten aluminum. To assure retention of the aluminum in the pores of the preform, heat treatment, e.g., at 1400° to 1800° C., in either a vacuum or in argon is required. Otherwise, either exposure of the pressure infiltrated material to gas or removal of the infiltration pressure will cause loss of aluminum from the body.

The use of wetting agents to effect infiltration of an alumina component in an electrolytic cell with molten metal is also shown in European Patent Application Publication No. 94353. This publication describes production of aluminum by electrowinning with a cell having a cathodic current feeder as a cell liner or substrate. In order to protect this substrate from molten cryolite, a thin coating of a mixture of a wetting agent and solubility suppressor is applied to the alumina substrate prior to start-up of the cell or while immersed in the molten aluminum produced by the electrolytic process. Wetting agents disclosed are titanium, zirconium, hafnium, silicon, magnesium, vanadium, chromium, niobium, or calcium, and titanium is stated as the preferred agent. Compounds of boron, carbon and nitrogen are described as being useful in suppressing the solubility of the wetting agents in molten aluminum. The reference, however, does not suggest the production of metal matrix composites, nor does it suggest the formation of such a composite in, for example, a nitrogen atmosphere.

In addition to application of pressure and wetting agents, it has been disclosed that an applied vacuum will aid the penetration of molten aluminum into a porous ceramic compact. For example, U.S. Pat. No. 3,718,441, granted Feb. 27, 1973, to R. L. Landingham, reports infiltration of a ceramic compact (e.g., boron carbide, alumina and beryllia) with either molten aluminum, beryllium, magnesium, titanium, vanadium, nickel or chromium under a vacuum of less than $10^{-6}$ torr. A vacuum of $10^{-2}$ to $10^{-6}$ torr resulted in poor wetting of the ceramic by the molten metal to the extent that the metal did not flow freely into the ceramic void spaces. However, wetting was said to have improved when the vacuum was reduced to less than $10^{-6}$ torr.

U.S. Pat. No. 3,864,154, granted Feb. 4, 1975, to G. E. Gazza et al., also shows the use of vacuum to achieve infiltration. This patent describes loading a cold-pressed compact of $AlB_{12}$ powder onto a bed of cold- pressed aluminum powder. Additional aluminum was then positioned on top of the $AlB_{12}$ powder compact. The crucible, loaded with the $AlB_{12}$ compact "sandwiched" between the layers of aluminum powder, was placed in a vacuum furnace. The furnace was evacuated to approximately $10^{-5}$ torr to permit outgassing. The temperature was subsequently raised to 1100° C. and maintained for a period of 3 hours. At these conditions, the molten aluminum penetrated the porous $AlB_{12}$ compact.

U.S. Pat. No. 3,364,976, granted Jan. 23, 1968, to John N. Reding et al., discloses the concept of creating a self-generated vacuum in a body to enhance penetration of a molten metal into the body. Specifically, it is disclosed that a body, e.g., a graphite mold, a steel mold, or a porous refractory material, is entirely submerged in a molten metal. In the case of a mold, the mold cavity, which is filled with a gas reactive with the metal, communicates with the externally located molten metal through at least one orifice in the mold. When the mold is immersed into the melt, filling of the cavity occurs as the self-generated vacuum is produced from the reaction between the gas in the cavity and the molten metal. Particularly, the vacuum is a result of the formation of a solid oxidized form of the metal. Thus, Reding et al. discloses that it is essential to induce a reaction between gas in the cavity and the molten metal. However, utilizing a mold to create a vacuum may be undesirable because of the inherent limitations associated with use of a mold. Molds must first be machined into a particular shape; then finished, machined to produce an acceptable casting surface on the mold; then assembled prior to their use; then disassembled after their use to remove the cast piece therefrom; and thereafter reclaim the mold, which most likely would include refinishing surfaces of the mold or discarding the mold if it is no longer acceptable for use. Machining of a mold into a complex shape can be very costly and time-consuming. Moreover, removal of a formed piece from a complex-shaped mold can also be difficult (i.e., cast pieces having a complex shape could be broken when removed from the mold). Still further, while there is a suggestion that a porous refractory material can be immersed directly in a molten metal without the need for a mold, the refractory material would have to be an integral piece because there is no provision for infiltrating a loose or separated porous material absent the use of a container mold (i.e., it is generally believed that the particulate material would typically disassociate or float apart when placed in a molten metal). Still further, if it was desired to infiltrate a particulate material or loosely formed preform, precautions should be taken so that the infiltrating metal does not displace at least portions of the particulate or preform resulting in a non-homogeneous microstructure.

Accordingly, there has been a long felt need for a simple and reliable process to produce shaped metal matrix composites which does not rely upon the use of applied pressure or vacuum (whether externally applied or internally created), or damaging wetting agents to create a metal matrix embedding another material such as a ceramic material. Moreover, there has been a long felt need to minimize the amount of final machining operations needed to produce a metal matrix composite body. The present invention satisfies these needs by providing a spontaneous infiltration mechanism for infiltrating a material (e.g., a ceramic material), which can be formed into a preform and/or supplied with a barrier, with molten matrix metal (e.g., aluminum) in the presence of an infiltrating atmosphere (e.g., nitrogen) under normal atmospheric pressures so long as an infiltration enhancer is present at least at some point during the process.

DESCRIPTION OF COMMONLY OWNED U.S. PATENT APPLICATIONS

The subject matter of this application is related to that of several other copending and co-owned patent applications. Particularly, these other copending patent applications describe novel methods for making metal matrix composite materials (hereinafter sometimes referred to as "Commonly Owned Metal Matrix Patent Applications").

A novel method of making a metal matrix composite material is disclosed in Commonly Owned U.S. patent application Ser. No. 049,171, filed May 13, 1987, in the names of White et al., and entitled "Metal Matrix Composites", which issued on May 9, 1989, as U.S. Pat. No. 4,828,008. According to the method of the White et al. invention, a metal matrix composite is produced by infiltrating a permeable mass of filler material (e.g., a ceramic or a ceramic-coated material) with molten aluminum containing at least about 1 percent by weight magnesium, and preferably at least about 3 percent by weight magnesium. Infiltration occurs spontaneously without the application of external pressure or vacuum. A supply of the molten metal alloy is contacted with the mass of filler material at a temperature of at least about 675° C. in the presence of a gas comprising from about 10 to 100 percent, and preferably at least about 50 percent, nitrogen by volume, and a remainder of the gas, if any, being a nonoxidizing gas, e.g., argon. Under these conditions, the molten aluminum alloy infiltrates the ceramic mass under normal atmospheric pressures to form an aluminum (or aluminum alloy) matrix composite. When the desired amount of filler material has been infiltrated with the molten aluminum alloy, the temperature is lowered to solidify the alloy, thereby forming a solid metal matrix structure that embeds the reinforcing filler material. Usually, and preferably, the supply of molten alloy delivered will be sufficient to permit the infiltration to proceed essentially to the boundaries of the mass of filler material. The amount of filler material in the aluminum matrix composites produced according to the White et al. invention may be exceedingly high. In this respect, filler to alloy volumetric ratios of greater than 1:1 may be achieved.

Under the process conditions in the aforesaid White et al. invention, aluminum nitride can form as a discontinuous phase dispersed throughout the aluminum matrix. The amount of nitride in the aluminum matrix may vary depending on such factors as temperature, alloy composition, gas composition and filler material. Thus, by controlling one or more such factors in the system, it is possible to tailor certain properties of the composite. For some end use applications, however, it may be desirable that the composite contain little or substantially no aluminum nitride.

It has been observed that higher temperatures favor infiltration but render the process more conducive to nitride formation. The White et al. invention allows the choice of a balance between infiltration kinetics and nitride formation.

An example of suitable barrier means for use with metal matrix composite formation is described in Commonly Owned and Copending U.S. patent application Ser. No. 141,642, filed Jan. 7, 1988, in the names of Michael K. Aghajanian et al., and entitled "Method of Making Metal Matrix Composite with the use of a Barrier". According to the method of this Aghajanian et al. invention, a barrier means (e.g., particulate titanium diboride or a graphite material such as a flexible graphite tape product sold by Union Carbide under the trade name Grafoil®) is disposed on a defined surface boundary of a filler material and matrix alloy infiltrates up to the boundary defined by the barrier means. The barrier means is used to inhibit, prevent, or terminate infiltration of the molten alloy, thereby providing net, or near net, shapes in the resultant metal matrix composite. Accordingly, the formed metal matrix composite bodies have an outer shape which substantially corresponds to the inner shape of the barrier means.

The method of U.S. patent application Ser. No. 049,171 was improved upon by Commonly Owned and Copending U.S. patent application Ser. No. 168,284, filed Mar. 15, 1988, in the names of Michael K. Aghajanian and Marc S. Newkirk and entitled "Metal Matrix Composites and Techniques for Making the Same." In accordance with the methods disclosed in this U.S. Patent Application, a matrix metal alloy is present as a first source of metal and as a reservoir of matrix metal alloy which communicates with the first source of molten metal due to, for example, gravity flow. Particularly, under the conditions described in this patent application, the first source of molten matrix alloy begins to infiltrate the mass of filler material under normal atmospheric pressures and thus begins the formation of a metal matrix composite. The first source of molten matrix metal alloy is consumed during its infiltration into the mass of filler material and, if desired, can be replenished, preferably by a continuous means, from the reservoir of molten matrix metal as the spontaneous infiltration continues. When a desired amount of permeable filler has been spontaneously infiltrated by the molten matrix alloy, the temperature is lowered to solidify the alloy, thereby forming a solid metal matrix structure that embeds the reinforcing filler material. It should be understood that the use of a reservoir of metal is simply one embodiment of the invention described in this patent application and it is not necessary to combine the reservoir embodiment with each of the alternate embodiments of the invention disclosed therein, some of which could also be beneficial to use in combination with the present invention.

The reservoir of metal can be present in an amount such that it provides for a sufficient amount of metal to infiltrate the permeable mass of filler material to a predetermined extent. Alternatively, an optional barrier means can contact the permeable mass of filler on at least one side thereof to define a surface boundary.

Moreover, while the supply of molten matrix alloy delivered should be at least sufficient to permit spontaneous infiltration to proceed essentially to the boundaries (e.g., barriers) of the permeable mass of filler material, the amount of alloy present in the reservoir could exceed such sufficient amount so that not only will there be a sufficient amount of alloy for complete infiltration, but excess molten metal alloy could remain and be attached to the metal matrix composite body. Thus, when excess molten alloy is present, the resulting body will be a complex composite body (e.g., a macrocomposite), wherein an infiltrated ceramic body having a metal matrix therein will be directly bonded to excess metal remaining in the reservoir.

Each of the above-discussed Commonly Owned Metal Matrix Patent Applications describes methods for the production of metal matrix composite bodies and novel metal matrix composite bodies which are produced therefrom. The entire disclosures of all of the foregoing Commonly Owned Metal Matrix Patent Applications are expressly incorporated herein by reference.

SUMMARY OF THE INVENTION

A macro composite body is produced by forming a metal matrix composite body which is contacted with and bonded to a second material. A metal matrix composite body is produced by spontaneously infiltrating a permeable mass of filler material or a preform with molten matrix metal. Specifically, an infiltration enhancer and/or infiltration precursor and/or an infiltrating atmosphere are in communication with the filler material or preform, at least at some point during the process, which permits molten matrix metal to spontaneously infiltrate the filler material or preform.

In a preferred embodiment of the invention, an infiltration enhancer may be supplied directly to at least one of the preform (or filler material) and/or matrix metal, and/or infiltrating atmosphere. Ultimately, at least during spontaneous infiltration, the infiltration enhancer should be located in at least a portion of the filler material or preform.

In a first preferred embodiment for forming a macrocomposite body, the quantity or amount of matrix metal supplied to spontaneously infiltrate the filler material or preform is provided in excess of that which is needed to achieve complete infiltration of the permeable material. Thus, residual or excess matrix metal (e.g., that matrix metal which was not utilized to infiltrate the filler material or preform) remains in contact with the infiltrated mass and becomes intimately bonded to the infiltrated mass. The amount, size, shape, and/or composition of the residual matrix metal can be controlled to produce a virtually limitless number of combinations. Moreover, the relative size of metal matrix composite to residual matrix metal can be controlled from one extreme of forming a metal matrix composite skin on a surface of residual matrix metal (e.g., only a small amount of spontaneous infiltration occurred) to another extreme of forming residual matrix metal as a skin on a surface of a metal matrix composite (e.g., only a small amount of excess matrix metal was provided).

In a second preferred embodiment, a filler material or preform is placed into contact with at least a portion of another or second body (e.g., a ceramic body or a metal body) and molten matrix metal spontaneously infiltrates the filler material or preform at least up to a surface of the second body causing the metal matrix composite to become intimately bonded to the second body. The bonding of the metal matrix composite to the second body may be due to the matrix metal and/or the filler material or preform reacting with the second body. Moreover, if the second body at least partially surrounds or substantially completely surrounds, or is surrounded by, the formed metal matrix composite, a shrink or compression fit may occur. Such shrink fit may be the only means of bonding the metal matrix composite to the second body or it may exist in combination with another bonding mechanism between the metal matrix composite or second body. Moreover, the amount of shrink fit can be controlled by selecting appropriate combinations of matrix metals, filler materials or preforms and/or second bodies to obtain a desirable match or selection of thermal expansion coefficients. Thus, for example, a metal matrix composite could be produced such that it has a higher coefficient of thermal expansion than a second body and the metal matrix composite surrounds, at least partially, a second body. In this example, the metal matrix composite would be bonded to the second by at least a shrink fit. Thus, a wide spectrum of macrocomposite bodies can be formed comprising a metal matrix composite bonded to a second body such as another ceramic or metal.

In a further preferred embodiment, excess or residual matrix metal is supplied to the above-discussed second preferred embodiment (e.g., the combination of metal matrix composite and second body). In this embodiment, similar to the first preferred embodiment discussed above herein, the quantity or amount of matrix metal supplied to spontaneously infiltrate the filler material or preform is provided in excess of that which is needed to achieve complete infiltration of the permeable material. Moreover, similar to the second preferred embodiment discussed above herein, a filler material or preform is placed into contact with at least a portion of another or second body (e.g., a ceramic body or metal body) and molten matrix metal spontaneously infiltrates the filler material or preform at least up to a surface of the second body causing the metal matrix composite to become intimately bonded to the second body. Thus, an even more complex macrocomposite body can be achieved than the macrocomposite discussed in the first two preferred embodiments. Specifically, by being able to select and combine a metal matrix composite with both a second body (e.g., a ceramic and/or a metal) and with excess or residual matrix metal, a virtually limitless number of permutations or combinations can be achieved. For example, if it was desired to produce a macrocomposite shaft or rod, an interior portion of the shaft could be a second body (e.g., a ceramic or a metal). The second body could be at least partially surrounded by a metal matrix composite. The metal matrix composite could then be at least partially surrounded by a second body or residual matrix metal. If the metal matrix composite was surrounded by residual matrix metal, another metal matrix composite could at least partially surround the residual matrix metal (e.g., the residual matrix metal could be supplied in a sufficient quantity such that it infiltrates both inward toward a filler material, or preform, which contacts an interior portion of a matrix metal and outward toward a filler material, or preform, which contacts an exterior portion of the matrix metal). Accordingly, significant engineering opportunities are provided by this third embodiment of the invention.

In each of the above-discussed preferred embodiments, a metal matrix composite body may be formed as either an exterior or interior surface, or both, on a substrate of matrix metal. Moreover, the metal matrix composite surface may be of a selected or predetermined thickness with respect to the size of the matrix metal substrate. The spontaneous infiltration techniques of the present invention enable the preparation of thick wall or thin wall metal matrix composite structures in which the relative volume of matrix metal providing the metal matrix composite surface is substantially greater than or less than the volume of matrix metal substrate. Still further, the metal matrix composite body, which may be either an exterior or interior surface or both, may be also bonded to a second material such as a ceramic or metal, thereby providing for a significant number of combinations of bonding between metal matrix composite, and/or excess matrix metal and/or a second body such as a ceramic or metal body.

In regard to the formation of the metal matrix composite body, it is noted that this application discusses primarily aluminum matrix metals which, at some point during the formation of the metal matrix composite body, are contacted with magnesium, which functions as the infiltration enhancer precursor, in the presence of nitrogen, which functions as the infiltrating atmosphere. Thus, the matrix metal/infiltration enhancer precursor-/infiltrating atmosphere system of aluminum/magnesium/nitrogen exhibits spontaneous infiltration. However, other matrix metal/infiltration enhancer precursor/infiltrating atmosphere systems may also behave in a manner similar to the system aluminum/magnesium/-nitrogen. For example, similar spontaneous infiltration behavior has been observed in the aluminum/strontium/nitrogen system; the aluminum/zinc/oxygen system; and the aluminum/calcium/nitrogen system. Accordingly, even though the aluminum/magnesium/nitrogen system is discussed primarily herein, it should be understood that other matrix metal/infiltration enhancer precursor/infiltrating atmosphere systems may behave in a similar manner.

When the matrix metal comprises an aluminum alloy, the aluminum alloy is contacted with a preform comprising a filler material (e.g., alumina or silicon carbide) or a filler material, said filler material or preform having admixed therewith, and/or at some point during the process being exposed to, magnesium. Moreover, in a preferred embodiment, the aluminum alloy and/or preform or filler material are contained in a nitrogen atmosphere for at least a portion of the process. The preform will be spontaneously infiltrated and the extent or rate of spontaneous infiltration and formation of metal matrix composite will vary with a given set of process conditions including, for example, the concentration of magnesium provided to the system (e.g., in the aluminum alloy and/or in the filler material or preform and-/or in the infiltrating atmosphere), the size and/or composition of the particles in the preform or filler material, the concentration of nitrogen in the infiltrating atmosphere, the time permitted for infiltration, and/or the temperature at which infiltration occurs. Spontaneous infiltration typically occurs to an extent sufficient to embed substantially completely the preform or filler material.

DEFINITIONS

"Aluminum", as used herein, means and includes essentially pure metal (e.g., a relatively pure, commercially available unalloyed aluminum) or other grades of metal and metal alloys such as the commercially available metals having impurities and/or alloying constituents such as iron, silicon, copper, magnesium, manganese, chromium, zinc, etc., therein. An aluminum alloy for purposes of this definition is an alloy or intermetallic compound in which aluminum is the major constituent.

"Balance Non-Oxidizinq Gas", as used herein, means that any gas present in addition to the primary gas comprising the infiltrating atmosphere, is either an inert gas or a reducing gas which is substantially non-reactive with the matrix metal under the process conditions. Any oxidizing gas which may be present as an impurity in the gas(es) used should be insufficient to oxidize the matrix metal to any substantial extent under the process conditions.

"Barrier" or "barrier means", as used herein, means any suitable means which interferes, inhibits, prevents or terminates the migration, movement, or the like, of molten matrix metal beyond a surface boundary of a permeable mass of filler material or preform, where such surface boundary is defined by said barrier means. Suitable barrier means may be any such material, compound, element, composition, or the like, which, under the process conditions, maintains some integrity and is not substantially volatile (i.e., the barrier material does not volatilize to such an extent that it is rendered non-functional as a barrier).

Further, suitable "barrier means" includes materials which are substantially non-wettable by the migrating molten matrix metal under the process conditions employed. A barrier of this type appears to exhibit substantially little or no affinity for the molten matrix metal, and movement beyond the defined surface boundary of the mass of filler material or preform is prevented or inhibited by the barrier means. The barrier reduces any final machining or grinding that may be required and defines at least a portion of the surface of the resulting metal matrix composite product. The barrier may in certain cases be permeable or porous, or rendered permeable by, for example, drilling holes or puncturing the barrier, to permit gas to contact the molten matrix metal.

"Carcass" or "Carcass of Matrix Metal", as used herein, refers to any of the original body of matrix metal remaining which has not been consumed during formation of the metal matrix composite body, and typically, if allowed to cool, remains in at least partial contact with the metal matrix composite body which has been formed. It should be understood that the carcass may also include a second or foreign metal therein.

"Excess Matrix Metal" or "Residual Matrix Metal", as used herein, means that quantity or amount of matrix metal which remains after a desired amount of spontaneous infiltration into a filler material or preform has been achieved and which is intimately bonded to the formed metal matrix composite. The excess or residual matrix metal may have a composition which is the same as or different from the matrix metal which has spontaneously infiltrated the filler material or preform.

"Filler", as used herein, is intended to include either single constituents or mixtures of constituents which are substantially nonreactive with and/or of limited solubility in the matrix metal and may be single or multi-phase. Fillers may be provided in a wide variety of forms, such as powders, flakes, platelets, microspheres, whiskers, bubbles, etc., and may be either dense or porous. "Filler" may also include ceramic fillers, such as alumina or silicon carbide as fibers, chopped fibers, particulates, whiskers, bubbles, spheres, fiber mats, or the like, and ceramic-coated fillers such as carbon fibers coated with alumina or silicon carbide to protect the carbon from attack, for example, by a molten aluminum parent metal. Fillers may also include metals.

"Infiltratinq Atmosphere", as used herein, means that atmosphere which is present which interacts with the matrix metal and/or preform (or filler material) and/or infiltration enhancer precursor and/or infiltration enhancer and permits or enhances spontaneous infiltration of the matrix metal to occur.

"Infiltration Enhancer", as used herein, means a material which promotes or assists in the spontaneous infiltration of a matrix metal into a filler material or preform. An infiltration enhancer may be formed from, for example, a reaction of an infiltration enhancer precursor with an infiltrating atmosphere to form (1) a gaseous species and/or (2) a reaction product of the infiltration enhancer precursor and the infiltrating atmosphere and/or (3) a reaction product of the infiltration enhancer precursor and the filler material or preform. Moreover, the infiltration enhancer may be supplied directly to at least one of the preform, and/or matrix metal, and/or infiltrating atmosphere and function in a substantially similar manner to an infiltration enhancer which has formed as a reaction between an infiltration enhancer precursor and another species. Ultimately, at least during the spontaneous infiltration, the infiltration enhancer should be located in at least a portion of the filler material or preform to achieve spontaneous infiltration.

"Infiltration Enhancer Precursor" or "Precursor to the Infiltration Enhancer", as used herein, means a material which when used in combination with the matrix metal, preform and/or infiltrating atmosphere forms an infiltration enhancer which induces or assists the matrix metal to spontaneously infiltrate the filler material or preform. Without wishing to be bound by any particular theory or explanation, it appears as though it may be necessary for the precursor to the infiltration enhancer to be capable of being positioned, located or transportable to a location which permits the infiltration enhancer precursor to interact with the infiltrating atmosphere and/or the preform or filler material and/or metal. For example, in some matrix metal/infiltration enhancer precursor/infiltrating atmosphere systems, it is desirable for the infiltration enhancer precursor to volatilize at, near, or in some cases, even somewhat above the temperature at which the matrix metal becomes molten. Such volatilization may lead to: (1) a reaction of the infiltration enhancer precursor with the infiltrating atmosphere to form a gaseous species which enhances wetting of the filler material or preform by the matrix metal; and/or (2) a reaction of the infiltration enhancer precursor with the infiltrating atmosphere to form a solid, liquid or gaseous infiltration enhancer in at least a portion of the filler material or preform which enhances wetting; and/or (3) a reaction of the infiltration enhancer precursor within the filler material or preform which forms a solid, liquid or gaseous infiltration enhancer in at least a portion of the filler material or preform which enhances wetting.

"Macrocomposite", as used herein, means any combination of two or more materials in any configuration which are intimately bonded together by, for example, a chemical reaction and/or a pressure or shrink fit, wherein at least one of the materials comprises a metal matrix composite formed by the spontaneous infiltration of molten matrix metal into a permeable mass of filler material, a preform, or a finished ceramic or metal body containing at least some porosity. The metal matrix composite may be present as an exterior surface and/or as an interior surface. It should be understood that the order, number, and/or location of a metal matrix composite body or bodies relative to residual matrix metal and/or second bodies can be manipulated or controlled in an unlimited fashion.

"Matrix Metal" or "Matrix Metal Alloy", as used herein, means that metal which is utilized to form a metal matrix composite (e.g., before infiltration) and/or that metal which is intermingled with a filler material to form a metal matrix composite body (e.g., after infiltration). When a specified metal is mentioned as the matrix metal, it should be understood that such matrix metal includes that metal as an essentially pure metal, a commercially available metal having impurities and/or alloying constituents therein, an intermetallic compound or an alloy in which that metal is the major or predominant constituent.

"Matrix Metal/Infiltration Enhancer Precursor/Infiltrating Atmosphere System" or "Spontaneous System", as used herein, refers to that combination of materials which exhibits spontaneous infiltration into a preform or filler material. It should be understood that whenever a "/" appears between an exemplary matrix metal, infiltration enhancer precursor and infiltrating atmosphere that, the "/" is used to designate a system or combination of materials which, when combined in a particular manner, exhibits spontaneous infiltration into a preform or filler material.

"Metal Matrix Composite" or "MMC", as used herein, means a material comprising a two- or three-dimensionally interconnected alloy or matrix metal which has embedded a preform or filler material. The matrix metal may include various alloying elements to provide specifically desired mechanical and physical properties in the resulting composite.

A Metal "Different" from the Matrix Metal means a metal which does not contain, as a primary constituent, the same metal as the matrix metal (e.g., if the primary constituent of the matrix metal is aluminum, the "different" metal could have a primary constituent of, for example, nickel).

"Nonreactive Vessel for Housing Matrix Metal" means any vessel which can house or contain molten matrix metal under the process conditions and not react with the matrix and/or the infiltrating atmosphere and/or infiltration enhancer precursor and/or filler material or preform in a manner which would be significantly detrimental to the spontaneous infiltration mechanism.

"Preform" or "Permeable Preform", as used herein, means a porous mass of filler or filler material which is finished (i.e., fully sintered or formed ceramic and metal bodies) with at least one surface boundary which essentially defines a boundary for infiltrating matrix metal, such mass retaining sufficient shape integrity and green strength to provide dimensional fidelity prior to being infiltrated by the matrix metal. The mass should be sufficiently porous to accommodate spontaneous infiltration of the matrix metal thereinto. A preform typically comprises a bonded array or arrangement of filler, either homogeneous or heterogeneous, and may be comprised of any suitable material (e.g., ceramic and/or metal particulates, powders, fibers, whiskers, etc., and any combination thereof). A preform may exist either singularly or as an assemblage.

"Reservoir", as used herein, means a separate body of matrix metal positioned relative to a mass of filler or a preform so that, when the metal is molten, it may flow to replenish, or in some cases to initially provide and subsequently replenish, that portion, segment or source of matrix metal which is in contact with the filler or preform.

"Second Body" or "Additional Body", as used herein, means another body which is capable of being bonded to a metal matrix composite body by at least one of a chemical reaction and/or a mechanical or shrink fit. Such a body includes traditional ceramics such as sintered ceramics, hot pressed ceramics, extruded ceramics, etc., and also, non-traditional ceramic and ceramic composite bodies such as those produced by the methods described in Commonly Owned U.S. Pat. No. 4,713,360, which issued on Dec. 15, 1987, in the names of Marc S. Newkirk et al.; Commonly Owned U.S.

patent application No. 819,397, filed Jan. 17, 1986 in the names of Marc S. Newkirk et al. and entitled "Composite Ceramic Articles and Methods of Making Same", now allowed; Commonly Owned and Copending U.S. patent application No. 861,025, filed May 8, 1986 in the names of Marc S. Newkirk et al. and entitled "Shaped Ceramic Composites and Methods of Making the Same"; Commonly Owned U.S. patent application No. 152,518 filed on Feb. 5, 1988 in the names of Robert C. Kantner et al. and entitled "Method For In Situ Tailoring the Metallic Component of Ceramic Articles and Articles Made Thereby", now allowed; Commonly Owned and Copending U.S. application No. 137,044, filed Dec. 23, 1987 in the names of T. Dennis Claar et al. and entitled "Process for Preparing Self-Supporting Bodies and Products Made Thereby"; and variations and improvements on these processes contained in other Commonly Owned Allowed and Copending U.S. Applications. For the purpose of teaching the method of production and characteristics of the ceramic and ceramic composite bodies disclosed and claimed in these commonly owned applications, the entire disclosures of the above-mentioned applications are hereby incorporated by reference. Moreover, the second or additional body of the instant invention also includes metal matrix composites and structural bodies of metal such as high temperature metals, corrosion resistant metals, erosion resistant metals, etc. Accordingly, a second or additional body includes a virtually unlimited number of bodies.

"Spontaneous Infiltration", as used herein, means that the infiltration of matrix metal into the permeable mass of filler or preform occurs without requirement for the application of pressure or vacuum (whether externally applied or internally created).

BRIEF DESCRIPTION OF THE FIGURES

The following Figures are provided to assist in understanding the invention, but are not intended to limit the scope of the invention. Similar reference numerals have been used wherever possible in each of the Figures to denote like components, wherein.

DETAILED DESCRIPTION OF THE INVENTION AND PREFERRED EMBODIMENTS

Figure 1:
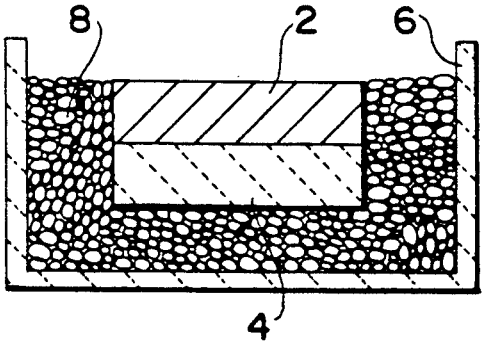
FIG. 1 is a cross-sectional view of the setup utilized to create the macrocomposite produced in Example 1.

The present invention relates to forming a macrocomposite body, a portion of which comprises a metal matrix composite body which has been formed by spontaneously infiltrating a filler material or preform with molten matrix metal.

A macro composite body according to the invention is produced by forming a metal matrix composite in contact with at least one second or additional body. Specifically, a metal matrix composite body is produced by spontaneously infiltrating a permeable mass of filler material or a preform with molten matrix metal. More specifically, an infiltration enhancer and/or infiltration precursor and/or an infiltrating atmosphere are in communication with the filler material or preform, at least at some point during the process, which permits molten matrix metal to spontaneously infiltrate the filler material or preform.

In a preferred embodiment of the invention, an infiltration enhancer may be supplied directly to at least one of the preform (or filler material) and/or matrix metal, and/or infiltrating atmosphere. Ultimately, at least during the spontaneous infiltration, the infiltration enhancer should be located in at least a portion of the filler material or preform.

In a first preferred embodiment for forming a macrocomposite body, the amount of matrix metal supplied to infiltrate is in excess of that needed to infiltrate. In other words, matrix metal is provided in a quantity which is greater than that which is needed to infiltrate completely the filler material or preform such that residual or excess matrix metal (e.g., that matrix metal which was not utilized to infiltrate the filler material or preform) is intimately bonded to the filler material or preform which has been infiltrated.

In another preferred embodiment, a filler material or preform is placed into contact with a second body of, for example, ceramic or metal. Molten matrix metal is then induced to spontaneously infiltrate the filler material or preform up to the second body and becomes intimately bonded to the second body thus forming a macrocomposite comprising a metal matrix composite body bonded to a second body of ceramic or metal.

In a further preferred embodiment, a filler material or preform is placed into contact with a second body such as another ceramic body or metal, and molten matrix metal is induced to spontaneously infiltrate the filler material or preform up to a contact point between the filler material or preform and the second body. The formed metal matrix composite body will be intimately bonded to the second body. Moreover, additional matrix metal can be supplied such that it is present in a quantity which is greater than that required to spontaneously infiltrate the filler material or preform. Accordingly, a macrocomposite body is formed comprising excess matrix metal which is intimately bonded to a metal matrix composite body which is intimately bonded to a second body such as a ceramic body, metal body, or ceramic composite body.

In the above-discussed preferred embodiments, a metal matrix composite body may be formed as either an exterior or interior surface, or both, on a substrate of matrix metal. Moreover, the metal matrix composite surface may be of a selected or predetermined thickness with respect to the size of the matrix metal substrate. The techniques of the present invention enable the preparation of thick wall or thin wall metal matrix composite structures in which the relative volume of matrix metal providing the metal matrix composite surface is substantially greater than or less than the volume of metal substrate. Still further, the metal matrix composite body which may be either an exterior or interior surface or both, may be also bonded to a second material such as a ceramic or metal, thereby providing for a significant number of combinations of bonding between metal matrix composite, and/or excess matrix metal and/or a second body such a ceramic or metal body.

Accordingly, the present invention can be utilized to meet or satisfy a large number of industrial demands thereby proving the efficacy of the present invention.

In order to form the macrocomposites of the present invention, a metal matrix composite body must be formed by the spontaneous infiltration of a matrix metal into a mass of filler material or a preform. In order to effect spontaneous infiltration of the matrix metal into the filler material or preform, an infiltration enhancer should be provided to the spontaneous system. An infiltration enhancer could be formed from an infiltration enhancer precursor which could be provided (1) in the matrix metal; and/or (2) in the filler material or preform; and/or (3) from the infiltrating atmosphere and/or (4) from an external source into the spontaneous system. Moreover, rather than supplying an infiltration enhancer precursor, an infiltration enhancer may be supplied directly to at least one of the filler material or preform, and/or matrix metal, and/or infiltrating atmosphere. Ultimately, at least during the spontaneous infiltration, the infiltration enhancer should be located in at least a portion of the filler material or preform.

In a preferred embodiment, it is possible that the infiltration enhancer precursor can be at least partially reacted with the infiltrating atmosphere such that infiltration enhancer can be formed in at least a portion of the filler material or preform prior to or substantially simultaneously with contacting the preform with molten matrix metal (e.g., if magnesium was the infiltration enhancer precursor and nitrogen was the infiltrating atmosphere, the infiltration enhancer could be magnesium nitride which would be located in at least a portion of the filler material or preform).

An example of a matrix metal/infiltration enhancer precursor/infiltrating atmosphere system is the aluminum/magnesium/nitrogen system. Specifically, an aluminum matrix metal can be contained within a suitable refractory vessel which, under the process conditions, does not react with the aluminum matrix metal when the aluminum is made molten. A filler material containing or being exposed to magnesium, and being exposed to, at least at some point during the processing, a nitrogen atmosphere, can then be contacted with the molten aluminum matrix metal. The matrix metal will then spontaneously infiltrate the filler material or preform.

Moreover, rather than supplying an infiltration enhancer precursor, an infiltration enhancer may be supplied directly to at least one of the preform, and/or matrix metal, and/or infiltrating atmosphere. Ultimately, at least during the spontaneous infiltration, the infiltration enhancer should be located in at least a portion of the filler material or preform.

Under the conditions employed in the method of the present invention, in the case of an aluminum/magnesium/nitrogen spontaneous infiltration system, the filler material or preform should be sufficiently permeable to permit the nitrogen-containing gas to penetrate or permeate the filler material or preform at some point during the process and/or contact the molten matrix metal. Moreover, the permeable filler material or preform can accommodate infiltration of the molten matrix metal, thereby causing the nitrogen-permeated filler material or preform to be infiltrated spontaneously with molten matrix metal to form a metal matrix composite body and/or cause the nitrogen to react with an infiltration enhancer precursor to form infiltration enhancer in the filler material or preform and thereby resulting in spontaneous infiltration. The extent or rate of spontaneous infiltration and formation of the metal matrix composite will vary with a given set of process conditions, including magnesium content of the aluminum alloy, magnesium content of the filler material or preform, amount of magnesium nitride in the filler material or preform, the presence of additional alloying elements (e.g., silicon, iron, copper, manganese, chromium, zinc, and the like), average size of the filler material (e.g., particle diameter), surface condition and type of filler material, nitrogen concentration of the infiltrating atmosphere, time permitted for infiltration and temperature at which infiltration occurs. For example, for infiltration of the molten aluminum matrix metal to occur spontaneously, the aluminum can be alloyed with at least about 1% by weight, and preferably at least about 3% by weight, magnesium (which functions as the infiltration enhancer precursor), based on alloy weight. Auxiliary alloying elements, as discussed above, may also be included in the matrix metal to tailor specific properties thereof. (Additionally, the auxiliary alloying elements may affect the minimum amount of magnesium required in the matrix aluminum metal to result in spontaneous infiltration of the filler material or preform.) Loss of magnesium from the spontaneous system due to, for example, volatilization should not occur to such an extent that no magnesium was present to form infiltration enhancer. Thus, it is desirable to utilize a sufficient amount of initial alloying elements to assure that spontaneous infiltration will not be adversely affected by volatilization. Still further, the presence of magnesium in both of the filler material or preform and matrix metal or the filler material or preform alone may result in a reduction in the required amount of magnesium to achieve spontaneous infiltration (discussed in greater detail later herein).

The volume percent of nitrogen in the nitrogen atmosphere also affects formation rates of the metal matrix composite body. Specifically, if less than about 10 volume percent of nitrogen is present in the atmosphere, very slow or little spontaneous infiltration will occur. It has been discovered that it is preferable for at least about 50 volume percent of nitrogen to be present in the atmosphere, thereby resulting in, for example, shorter infiltration times due to a much more rapid rate of infiltration. The infiltrating atmosphere (e.g., a nitrogen-containing gas) can be supplied directly to the filler material or preform and/or matrix metal, or it may be produced or result from a decomposition of a material.

The minimum magnesium content required for the molten matrix metal to infiltrate a filler material or preform depends on one or more variables such as the processing temperature, time, the presence of auxiliary alloying elements such as silicon or zinc, the nature of the filler material, the location of the magnesium in one or more components of the spontaneous system, the nitrogen content of the atmosphere, and the rate at which the nitrogen atmosphere flows. Lower temperatures or shorter heating times can be used to obtain complete infiltration as the magnesium content of the alloy and/or preform is increased. Also, for a given magnesium content, the addition of certain auxiliary alloying elements such as zinc permits the use of lower temperatures. For example, a magnesium content of the matrix metal at the lower end of the operable range, e.g., from about 1 to 3 weight percent, may be used in conjunction with at least one of the following: an above-minimum processing temperature, a high nitrogen concentration, or one or more auxiliary alloying elements. When no magnesium is added to the filler material or preform, alloys containing from about 3 to 5 weight percent magnesium are preferred on the basis of their general utility over a wide variety of process conditions, with at least about 5 percent being preferred when lower temperatures and shorter times are employed. Magnesium contents in excess of about 10 percent by weight of the aluminum alloy may be employed to moderate the temperature conditions required for infiltration. The magnesium content may be reduced when used in conjunction with an auxiliary alloying element, but these elements serve an auxiliary function only and are used together with at least the above-specified minimum amount of magnesium. For example, there was substantially no infiltration of nominally pure aluminum alloyed only with 10 percent silicon at 1000° C. into a bedding of 500 mesh, 39 Crystolon (99 percent pure silicon carbide from Norton Co.). However, in the presence of magnesium, silicon has been found to promote the infiltration process. As a further example, the amount of magnesium varies if it is supplied exclusively to the preform or filler material. It has been discovered that spontaneous infiltration will occur with a lesser weight percent of magnesium supplied to the spontaneous system when at least some of the total amount of magnesium supplied is placed in the preform or filler material. It may be desirable for a lesser amount of magnesium to be provided in order to prevent the formation of undesirable intermetallics in the metal matrix composite body. In the case of a silicon carbide preform, it has been discovered that when the preform is contacted with an aluminum matrix metal, the preform containing at least about 1% by weight magnesium and being in the presence of a substantially pure nitrogen atmosphere, the matrix metal spontaneously infiltrates the preform. In the case of an alumina preform, the amount of magnesium required to achieve acceptable spontaneous infiltration is slightly higher. Specifically, it has been found that when an alumina preform is contacted with a similar aluminum matrix metal, at about the same temperature as the aluminum that infiltrated into the silicon carbide preform, and in the presence of the same nitrogen atmosphere, at least about 3% by weight magnesium may be required to achieve similar spontaneous infiltration to that achieved in the silicon carbide preform discussed immediately above.

It is also noted that it is possible to supply to the spontaneous system infiltration enhancer precursor and/or infiltration enhancer on a surface of the alloy and/or on a surface of the preform or filler material and/or within the preform or filler material prior to infiltrating the matrix metal into the filler material or preform (i.e., it may not be necessary for the supplied infiltration enhancer or infiltration enhancer precursor to be alloyed with the matrix metal, but rather, simply supplied to the spontaneous system). If the magnesium was applied to a surface of the matrix metal, it may be preferred that said surface should be the surface which is closest to, or preferably in contact with, the permeable mass of filler material or vice versa; or such magnesium could be mixed into at least a portion of the preform or filler material. Still further, it is possible that some combination of surface application, alloying and placement of magnesium into at least a portion of the preform could be used. Such combination of applying infiltration enhancer(s) and/or infiltration enhancer precursor(s) could result in a decrease in the total weight percent of magnesium needed to promote infiltration of the matrix aluminum metal into the preform, as well as achieving lower temperatures at which infiltration can occur. Moreover, the amount of undesirable intermetallics formed due to the presence of magnesium could also be minimized.

The use of one or more auxiliary alloying elements and the concentration of nitrogen in the surrounding gas also affects the extent of nitriding of the matrix metal at a given temperature. For example, auxiliary alloying elements such as zinc or iron included in the alloy, or placed on a surface of the alloy, may be used to reduce the infiltration temperature and thereby decrease the amount of nitride formation, whereas increasing the concentration of nitrogen in the gas may be used to promote nitride formation.

The concentration of magnesium in the alloy, and/or placed onto a surface of the alloy, and/or combined in the filler or preform material, also tends to affect the extent of infiltration at a given temperature. Consequently, in some cases where little or no magnesium is contacted directly with the preform or filler material, it may be preferred that at least about three weight percent magnesium be included in the alloy. Alloy contents of less than this amount, such as one weight percent magnesium, may require higher process temperatures or an auxiliary alloying element for infiltration. The temperature required to effect the spontaneous infiltration process of this invention may be lower: (1) when the magnesium content of the alloy alone is increased, e.g. to at least about 5 weight percent; and/or (2) when alloying constituents are mixed with the permeable mass of filler material or preform; and/or (3) when another element such as zinc or iron is present in the aluminum alloy. The temperature also may vary with different filler materials. In general, spontaneous and progressive infiltration will occur at a process temperature of at least about 675° C., and preferably a process temperature of at least about 750° C.-800° C. Temperatures generally in excess of 1200° C. do not appear to benefit the process, and a particularly useful temperature range has been found to be from about 675° C. to about 1200° C. However, as a general rule, the spontaneous infiltration temperature is a temperature which is above the melting point of the matrix metal but below the volatilization temperature of the matrix metal. Moreover, the spontaneous infiltration temperature should be below the melting point of the filler material or preform unless the filler material or preform is provided with a means of support which will maintain the porous geometry of the filler material or preform during the infiltration step. Such a support means could comprise a coating on the filler particles or preform passageways, or certain constituents of the mass of filler or preform could be non-molten at the infiltration temperature while other constituents were molten. In this latter embodiment, the non-molten constituents could support the molten constituents and maintain adequate porosity for spontaneous infiltration of the filler material or preform. Still further, as temperature is increased, the tendency to form a reaction product between the matrix metal and infiltrating atmosphere increases (e.g., in the case of aluminum matrix metal and a nitrogen infiltrating atmosphere, aluminum nitride may be formed). Such reaction product may be desirable or undesirable based upon the intended application of the metal matrix composite body. Additionally, electric resistance heating is typically used to achieve the infiltrating temperatures. However, any heating means which can cause the matrix metal to become molten and does not adversely affect spontaneous infiltration, is acceptable for use with the invention.

In the present method, for example, a permeable filler material or preform comes into contact with molten aluminum in the presence of, at least sometime during the process, a nitrogen-containing gas. The nitrogen-containing gas may be supplied by maintaining a continuous flow of gas into contact with at least one of the filler material or the preform and/or molten aluminum matrix metal. Although the flow rate of the nitrogen-containing gas is not critical, it is preferred that the flow rate be sufficient to compensate for any nitrogen lost from the atmosphere due to nitride formation in the alloy matrix, and also to prevent or inhibit the incursion of air which can have an oxidizing effect on the molten metal.

The method of forming a metal matrix composite is applicable to a wide variety of filler materials, and the choice of filler materials will depend on such factors as the matrix alloy, the process conditions, the reactivity of the molten matrix alloy with the filler material, and the properties sought for the final composite product. For example, when aluminum is the matrix metal, suitable filler materials include (a) oxides, e.g. alumina; (b) carbides, e.g. silicon carbide; (c) borides, e.g. aluminum dodecaboride, and (d) nitrides, e.g. aluminum nitride. If there is a tendency for the filler material to react with the molten aluminum matrix metal, this might be accommodated by minimizing the infiltration time and temperature or by providing a non-reactive coating on the filler. The filler material may comprise a substrate, such as carbon or other non-ceramic material, bearing a ceramic coating to protect the substrate from attack or degradation. Suitable ceramic coatings include oxides, carbides, borides and nitrides. Ceramics which are preferred for use in the present method include alumina and silicon carbide in the form of particles, platelets, whiskers and fibers. The fibers can be discontinuous (in chopped form) or in the form of continuous filament, such as multifilament tows. Further, the filler material or preform may be homogeneous or heterogeneous.

It also has been discovered that certain filler materials exhibit enhanced infiltration relative to filler materials by having a similar chemical composition. For example, crushed alumina bodies made by the method disclosed in U.S. Pat. No. 4,713,360, entitled "Novel Ceramic Materials and Methods of Making Same", which issued on Dec. 15, 1987, in the names of Marc S. Newkirk et al., exhibit desirable infiltration properties relative to commercially available alumina products. Moreover, crushed alumina bodies made by the method disclosed in Copending and Commonly Owned Application Serial No. 819,397 entitled "Composite Ceramic Articles and Methods of Making Same", in the names of Marc S. Newkirk et al., which issued on July 25, 1989, as U.S. Pat. No. 4,851,375 also exhibits desirable infiltration properties relative to commercially available alumina products. The subject matter of each of the issued Patent and Copending Patent Application is herein expressly incorporated by reference. Thus, it has been discovered that complete infiltration of a permeable mass of ceramic material can occur at lower infiltration temperatures and/or lower infiltration times by utilizing a crushed or comminuted body produced by the method of the aforementioned U.S. Patent and Patent Application.

The size and shape of the filler material can be any that may be required to achieve the properties desired in the composite. Thus, the material may be in the form of particles, whiskers, platelets or fibers since infiltration is not restricted by the shape of the filler material. Other shapes such as spheres, tubules, pellets, refractory fiber cloth, and the like may be employed. In addition, the size of the material does not limit infiltration, although a higher temperature or longer time period may be needed for complete infiltration of a mass of smaller particles than for larger particles. Further, the mass of filler material (shaped into a preform) to be infiltrated should be permeable (i.e., permeable to molten matrix metal and to the infiltrating atmosphere). In the case of aluminum alloys, the infiltrating atmosphere may comprise a nitrogen-containing gas.

The method of forming metal matrix composites according to the present invention, not being dependent on the use of pressure to o force or squeeze molten metal matrix into a preform or a mass of filler material, permits the production of substantially uniform metal matrix composites having a high volume fraction of filler material and low porosity. Higher volume fractions of filler material may be achieved by using a lower porosity initial mass of filler material. Higher volume fractions also may be achieved if the mass of filler is compacted or otherwise densified provided that the mass is not converted into either a compact with close cell porosity or into a fully dense structure that would prevent infiltration by the molten alloy (i.e., a structure having insufficient porosity for spontaneous infiltration to occur).

It has been observed that for aluminum infiltration and matrix formation around a ceramic filler, wetting of the ceramic filler by the aluminum matrix metal may be an important part of the infiltration mechanism. Moreover, at low processing temperatures, a negligible or minimal amount of metal nitriding occurs resulting in a minimal discontinuous phase of aluminum nitride dispersed in the metal matrix. However, as the upper end of the temperature range is approached, nitridation of the metal is more likely to occur. Thus, the amount of the nitride phase in the metal matrix can be controlled by varying the processing temperature at which infiltration occurs. The specific process temperature at which nitride formation becomes more pronounced also varies with such factors as the matrix aluminum alloy used and its quantity relative to the volume of filler or preform, the filler material to be infiltrated, and the nitrogen concentration of the infiltrating atmosphere. For example, the extent of aluminum nitride formation at a given process temperature is believed to increase as the ability of the alloy to wet the filler decreases and as the nitrogen concentration of the atmosphere increases.

It is therefore possible to tailor the constituency of the metal matrix during formation of the composite to impart certain characteristics to the resulting product. For a given system, the process conditions can be selected to control the nitride formation. A composite product containing an aluminum nitride phase will exhibit certain properties which can be favorable to, or improve the performance of, the product. Further, the temperature range for spontaneous infiltration with an aluminum alloy may vary with the ceramic material used. In the case of alumina as the filler material, the temperature for infiltration should preferably not exceed about 1000° C. if it is desired that the ductility of the matrix not be reduced by the significant formation of nitride. However, temperatures exceeding 1000° C. may be employed if it is desired to produce a composite with a less ductile and stiffer matrix. To infiltrate silicon carbide, higher temperatures of about 1200° C. may be employed since the aluminum alloy nitrides to a lesser extent, relative to the use of alumina as filler, when silicon carbide is employed as a filler material.

Moreover, it is possible to use a reservoir of matrix metal to assure complete infiltration of the filler material and/or to supply a second metal which has a different composition from the first source of matrix metal. Specifically, in some cases it may be desirable to utilize a matrix metal in the reservoir which differs in composition from the first source of matrix metal. For example, if an aluminum alloy is used as the first source of matrix metal, then virtually any other metal or metal alloy which was molten at the processing temperature could be used as the reservoir metal. Molten metals frequently are very miscible with each other which would result in the reservoir metal mixing with the first source of matrix metal so long as an adequate amount of time is given for the mixing to occur. Thus, by using a reservoir metal which is different in composition than the first source of matrix metal, it is possible to tailor the properties of the metal matrix to meet various operating requirements and thus tailor the properties of the metal matrix composite.

A barrier means may also be utilized in combination with the present invention. Specifically, the barrier means for use with this invention may be any suitable means which interferes, inhibits, prevents or terminates the migration, movement, or the like, of molten matrix alloy (e.g., an aluminum alloy) beyond the defined surface boundary of the filler material. Suitable barrier means may be any material, compound, element, composition, or the like, which, under the process conditions of this invention, maintains some integrity, is not volatile and preferably is permeable to the gas used with the process as well as being capable of locally inhibiting, stopping, interfering with, preventing, or the like, continued infiltration or any other kind of movement beyond the defined surface boundary of the ceramic filler.

Suitable barrier means includes materials which are substantially non-wettable by the migrating molten matrix alloy under the process conditions employed. A barrier of this type appears to exhibit little or no affinity for the molten matrix alloy, and movement beyond the defined surface boundary of the filler material or preform is prevented or inhibited by the barrier means. The barrier reduces any final machining or grinding that may be required of the metal matrix composite product. As stated above, the barrier preferably should be permeable or porous, or rendered permeable by puncturing, to permit the gas to contact the molten matrix alloy.

Suitable barriers particularly useful for aluminum matrix alloys are those containing carbon, especially the crystalline allotropic form of carbon known as graphite. Graphite is essentially nonwettable by the molten aluminum alloy under the described process conditions. A particular preferred graphite is a graphite tape product that is sold under the trademark Grafoil®, registered to Union Carbide. This graphite tape exhibits sealing characteristics that prevent the migration of molten aluminum alloy beyond the defined surface boundary of the filler material. This graphite tape is also resistant to heat and is chemically inert. Grafoil® graphite material is flexible, compatible, conformable and resilient. It can be made into a variety of shapes to fit any barrier application. However, graphite barrier means may be employed as a slurry or paste or even as a paint film around and on the boundary of the filler material or preform. Grafoil® is particularly preferred because it is in the form of a flexible graphite sheet. In use, this paper-like graphite is simply formed around the filler material or preform.

Other preferred barrier(s) for aluminum metal matrix alloys in nitrogen are the transition metal borides (e.g., titanium diboride ($TiB_2$)) which are generally non-wettable by the molten aluminum metal alloy under certain of the process conditions employed using this material. With a barrier of this type, the process temperature should not exceed about 875° C., for otherwise the barrier material becomes less efficacious and, in fact, with increased temperature infiltration into the barrier will occur. The transition metal borides are typically in a particulate form (1-30 microns). The barrier materials may be applied as a slurry or paste to the boundaries of the permeable mass of ceramic filler material which preferably is preshaped as a preform.

Other useful barriers for aluminum metal matrix alloys in nitrogen include low-volatile organic compounds applied as a film or layer onto the external surface of the filler material or preform. Upon firing in nitrogen, especially at the process conditions of this invention, the organic compound decomposes leaving a carbon soot film. The organic compound may be applied by conventional means such as painting, spraying, dipping, etc.

Moreover, finely ground particulate materials can function as a barrier so long as infiltration of the particulate material would occur at a rate which is slower than the rate of infiltration of the filler material.

Thus, the barrier means may be applied by any suitable means, such as by covering the defined surface boundary with a layer of the barrier means. Such a layer of barrier means may be applied by painting, dipping, silk screening, evaporating, or otherwise applying the barrier means in liquid, slurry, or paste form, or by sputtering a vaporizable barrier means, or by simply depositing a layer of a solid particulate barrier means, or by applying a solid thin sheet or film of barrier means onto the defined surface boundary. With the barrier means in place, spontaneous infiltration substantially terminates when the infiltrating matrix metal reaches the defined surface boundary and contacts the barrier means.

Through use of the techniques described above, the present invention provides a technique whereby a shaped metal matrix composite can be bonded or integrally attached to at least one second or additional body. This body may comprise: a ceramic matrix body; a ceramic matrix composite body, i.e., a ceramic matrix embedding filler material; a body of metal; a metal matrix composite; and/or any combination of the above listed materials. The final product produced by the present invention is a macrocomposite which comprises at least one metal matrix composite, formed by the spontaneous infiltration of a mass of filler material or a preform with a matrix metal, which is bonded or integrally attached to at least one body comprised of at least one of the materials listed above. Thus, the final product of the present invention can comprise a virtually limitless number of permutations and combinations of spontaneously infiltrated metal matrix composites which are bonded on one or more surfaces to at least one body comprised of at least one of the materials listed above.

As demonstrated in Examples 2, 3 and 5, the present invention permits the formation of multi-layered macrocomposites in a single spontaneous infiltration step. Specifically, a molten matrix metal may be spontaneously infiltrated into a mass of filler material or a preform which is in contact with a second or additional body, such as a ceramic body. Upon infiltrating the filler material or preform to the interface of said filler material or preform with said second or additional body, the molten matrix metal, either alone or in combination with the filler material or preform, interacts with said second or additional body in such a way as to permit bonding or an integral attachment of the metal matrix composite body to the second or additional body upon cooling of the system. Thus, through utilization of the techniques described in Examples 2, 3 and 5, any number of second or additional bodies could be placed in or around a mass of filler material or preform so that when molten matrix metal infiltrates the mass of filler material or preform to the interface of said filler material or preform and said second or additional bodies, an integral attachment or bonding will occur between the metal matrix composite and the other bodies, upon cooling of the system to a temperature which is both below the melting point of the matrix metal and the melting point of all other bodies in the system.

In addition to forming a strong bond or integral attachment between the spontaneously infiltrated metal matrix composite and the second or additional body or bodies, the instant invention also provides a technique whereby the second or additional body or bodies may be placed in compression by the metal matrix composite. Alternatively, the metal matrix composite could be placed in compression by the second or additional body or bodies. Thus, the metal matrix composite may at least partially contain the other body and, if the coefficient of thermal expansion of the metal matrix composite is greater than the coefficient of thermal expansion of the second or additional body or bodies so contained, the metal matrix composite will place the contained body under compression upon cooling from infiltration temperature. Alternatively, the metal matrix composite body could be formed at least partially within a second or additional body having a higher coefficient of thermal expansion than the metal matrix composite body. Thus, upon cooling, the portion of the metal matrix composite which is contained within the second or additional body will be placed under compression by the second or additional body.

The technique of the instant invention can be adapted to produce a continuous macrocomposite chain of virtually any length. Specifically, the process of the instant invention could be adapted to a continuous production method where, for example, a continuous stream of raw materials may be passed through a furnace which heats the matrix metal to a temperature above its melting point; said matrix metal being in a molten state for a sufficient time for said molten matrix metal to infiltrate a predetermined volume of filler material or preform; and thereafter, as the infiltrated filler material is cooled (e.g., removed from the furnace) said matrix metal cools to solidification temperature, thereby forming a metal matrix composite. Through the utilization of this continuous process, a metal matrix composite could be bonded to a second material which would be bonded to another metal matrix composite, which would be bonded to another second material, and so on. The molten matrix metal could be supplied in situ or could be continuously supplied to the furnace through a second stream which is supplied from, for example, a reservoir of matrix metal. In addition, a layer of barrier material, such as Grafoil® (described herein), could be interposed between predetermined segments of the macrocomposite chain, thereby terminating the chain at the barrier layer.

The integral attachment or bonding of the metal matrix composite to the second or additional body can be enhanced through the use of mechanical bonding techniques. Specifically, the surface of one or both of the metal matrix composite or the second or additional body can have notches, holes, slots, or any other surface irregularities which are matched with the corresponding inverse shape on the surface of the body to which the bond or attachment is to be made. These inversely matching irregularities can create a mechanical bond in addition to any chemical bond which may be produced between the metal matrix composite and the second or additional body. The combination of these bonds or attachment mechanisms can produce a much stronger bond or attachment than either bond or attachment mechanism separately.

The products produced by the technique of the instant invention will be useful for industrial applications requiring surfaces which must withstand high temperature, abrasion, corrosion, erosion, thermal stress, friction, and/or many other stresses. Thus, the process disclosed and claimed in the instant application will be useful in the production of virtually any industrial product which can have its performance enhanced through the use of surfaces comprised of metal matrix composites, ceramic matrix composites, metals, or combinations of the above. By providing techniques for creating macrocomposites having layers of materials which differ in their properties and characteristics, a wealth of industrial applications which heretofore were thought impractical or impossible to satisfy through the use of conventional materials, may now be satisfied through proper engineering of the macrocomposites produced by the process of the present invention. Particularly, industrial applications which require one section of a body to withstand a certain set of conditions and another part of the body to withstand a different set of conditions may now be satisfied through use of two or more different types of materials which are formed into a macrocomposite having the shape of the desired industrial piece. Moreover, through the use of the preform and barrier techniques described herein, net or near net shape macrocomposites can be formed which require little or no final machining after the spontaneous infiltration step.

Thus, the products produced by the method of the present invention have a virtually limitless industrial potential and may help to satisfy many of the most challenging engineering requirements existing in the materials world today.

Various demonstrations of the present invention are included in the Examples immediately following. However, these Examples should be considered as being illustrative and should not be construed as limiting the scope of the invention as defined in the appended claims.

EXAMPLE 1

This Example demonstrates that it is possible to utilize the spontaneous infiltration of a molten matrix metal into a shaped preform to obtain a shaped metal matrix composite body which is integrally attached or bonded to a solid piece of matrix metal.

Referring to FIG. 1, an ingot (2) of matrix metal, measuring approximately 2 inches by 2 inches by ½ inch and composed by weight of approximately 5% silicon, 5% Mg, and the balance aluminum, was placed on top of a preform (4) having approximate dimensions 2 inches by 2 inches by ½ inch. The preform (4) was produced by mixing C-75 unground calcined alumina from Alcan and Elmer's Wood Glue (from Bordon Co.). The weight of Elmer's Wood glue utilized was approximately 10% of the weight of C-75 unground calcified alumina. Enough water was added to this Elmer's Wood glue/alumina mixture to create a slurry. The slurry was well mixed and cast into a rubber mold. The rubber mold and its contents were then placed into a freezer until the contents of the rubber mold were completely frozen. At this point, the frozen preform was removed from the rubber mold and allowed to dry.

As shown in FIG. 1, the preform (4) and matrix metal ingot (2) assembly was placed on top of an approximately ½ inch thick layer of Grade HTC titanium diboride from Union Carbide contained within an alumina refractory boat (6) obtained from Bolt Technical Ceramics. Additional Grade HTC titanium diboride was then added to the refractory boat (6) until the surface of the titanium diboride bed (8) was approximately level with the upper surface of the matrix metal ingot (2).

Figure 2:
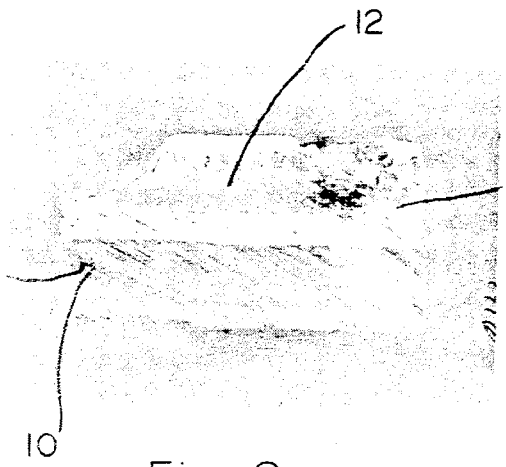
FIG. 2 is a photograph of a cross-section of the macrocomposite produced in Example 1.

The setup, consisting of the refractory boat (6) and its contents were placed within a controlled atmosphere electric resistance heated vacuum furnace at room temperature. A high vacuum (approximately $1\times10^{-4}$ torr) was created within the furnace and maintained as the temperature was raised from room temperature to about 200° C. The furnace and its contents were held at about 200° C. for about two hours before forming gas (approximately 96% by volume nitrogen, 4% by volume hydrogen) was backfilled into the furnace to approximately one atmosphere and a continuous forming gas flow rate of approximately 1000 cc/min was established. The furnace temperature was then ramped to about 875° C. over about 10 hours; held at about 875° C. for about 15 hours; and ramped to room temperature in about 5 hours. Upon reaching room temperature, the setup was removed from the furnace and disassembled. A metal matrix composite comprising the alumina preform infiltrated by matrix metal was recovered. As shown in FIG. 2, the metal matrix composite (10) was integrally bonded with excess residual matrix metal (12).

Thus, this Example has demonstrated that through the use of spontaneous infiltration, it is possible to create a shaped metal matrix composite body which is integrally bonded to a solid piece of excess matrix metal.

EXAMPLE 2

The following Example demonstrates that it is possible to spontaneously infiltrate a bed of filler material with matrix metal to produce a macrocomposite which comprises excess matrix metal which is integrally attached or bonded to a metal matrix composite which is in turn integrally attached or bonded to a ceramic body.

Figure 3:
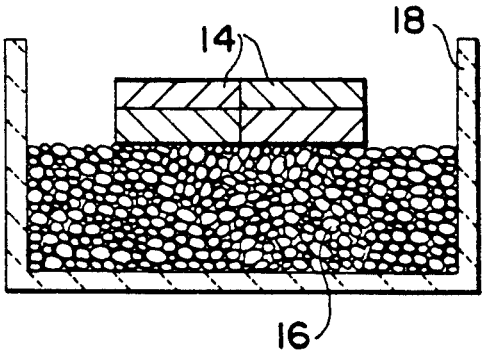
FIG. 3 is a cross-sectional view of the setup utilized to produce the macrocomposite in Example 2.

As shown in FIG. 3, four matrix metal ingots (14), each measuring approximately 2 inches by 1 inch by ½ inch and composed by weight of approximately 3% silicon, 3% Mg and the balance aluminum, were placed on top of a bed (16) of a 90 grit alumina material known by the trade name 38 Alundum and produced by Norton Co. The bed (16) of 90 grit, 38 Alundum was contained within an alumina refractory boat (18), produced by Bolt Technical Ceramics. The matrix metal ingots (14) were arranged as displayed in FIG. 3.

The setup, consisting of the alumina refractory boat (18) and its contents, was placed within a tube furnace and forming gas (approximately 96% by volume nitrogen, 4% by volume hydrogen) was flowed through the furnace at a gas flow rate of about 300 cc/min. The furnace temperature was then raised from room temperature to about 1000° C. over about 10 hours; maintained at about 1000° C. for about 10 hours; and then ramped to room temperature over about 6 hours.

Figure 4:
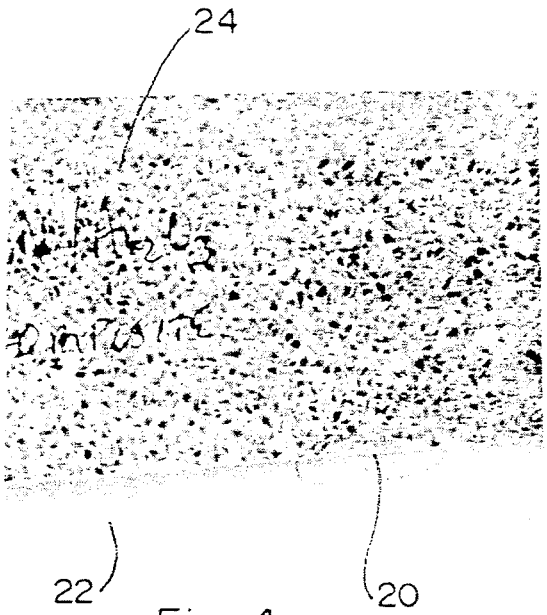
FIG. 4 is a photomicrograph showing the interface between the alumina refractory boat and the metal matrix composite produced in Example 2.

After reaching room temperature, the setup was removed from the furnace and disassembled. A metal matrix composite comprising the 90 grit, 38 Alundum infiltrated by the matrix metal was recovered. The metal matrix composite was integrally attached to or bonded with both the alumina refractory boat (18) and a body of excess matrix metal. FIG. 4 is a photomicrograph showing the interface (20) between the alumina refractory boat (22) and the metal matrix composite (24). This Figure demonstrates that a good bond or attachment is obtained at the metal matrix composite-alumina refractory boat interface. Although it is not shown in FIG. 4, there was also a strong bond or good attachment at the excess matrix metal-metal matrix composite interface. This bond is evidenced by the fact that the excess matrix metal could not be removed without machining.

Figure 5:
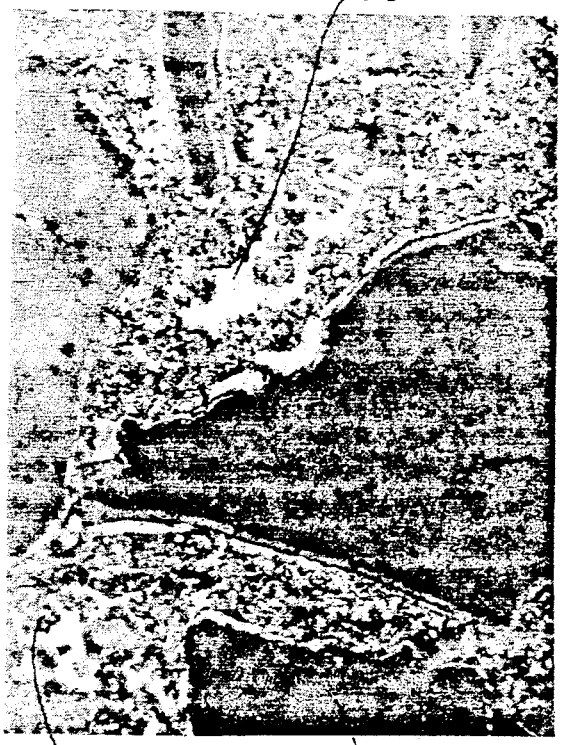
FIG. 5 is a photomicrograph taken at a high level of magnification of the microstructure of the metal matrix composite formed in Example 2.

FIG. 5 is a photomicrograph taken at a high level of magnification of the microstructure of the metal matrix composite formed in the present Example. As indicated by the lines labeled (26), significant amounts of aluminum nitride were formed within the metal matrix composite. The aluminum nitride (26) appears as the dark grey phase in FIG. 5 while the matrix metal (28) appears as the light gray phase and the 90 grit, 38 Alundum appears as the dark colored particulate (30). Accordingly, this example demonstrates that it is possible to tailor the microstructure of the metal matrix composite to contain reaction products between the infiltrating matrix metal and the infiltrating atmosphere.

Thus, this Example demonstrates that it is possible to utilize spontaneous infiltration to create a macrocomposite comprising excess matrix metal which is integrally attached or bonded to a metal matrix composite body which is in turn integrally attached or bonded to a ceramic body. Further, this example demonstrates that the microstructure of the metal matrix composite may be modified by allowing reaction products to form between the matrix metal and the infiltrating atmosphere.

EXAMPLE 3

The following Example demonstrates that it is possible to create a macrocomposite which comprises excess matrix metal which is integrally attached or bonded to a metal matrix composite which is in turn integrally attached or bonded to a ceramic body.

Figure 6:
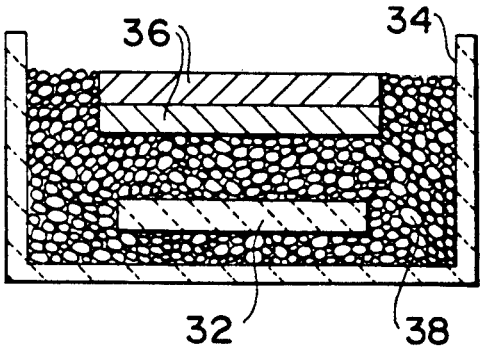
FIG. 6 is a cross-sectional view of the setup utilized to produce the macrocomposite in Example 3.

As shown in FIG. 6, a commercially available alumina plate (32) (AD85, made by Coors) having approximate dimensions of 3 inches by 4 inches by ½ inch was placed within an alumina refractory boat (34) on top of an approximately ½ inch thick layer of a 90 grit alumina material known by the trade name 38 Alundum and produced by Norton Co. Additional 38 Alundum was then added to the refractory boat (34) until the alumina plate (32) was covered with an approximately 1 inch thick layer of the 38 Alundum. Two bars (36) of a matrix metal composed by weight of approximately 5% silicon, 3% Mg, 6% zinc, and the balance aluminum, were placed on top of the 38 Alundum so that they were directly above the alumina plate. Each bar (36) of matrix metal had approximate dimensions of 4½ inches by 2 inches by ½ inch and the two matrix metal bars (36) were stacked one on top of the other, as shown in FIG. 6. At this point, additional 38 Alundum was added to the refractory boat (34) until the surface of the bed (38) of 38 Alundum was approximately level with the surface of the upper matrix metal bar (36).

The setup, consisting of the alumina refractory boat (34) and its contents, was placed within an electrical resistance heated muffle tube furnace at room temperature and a continuous gas flow rate of about 350 cc/min of forming gas (approximately 96% by volume nitrogen, 4% by volume hydrogen) was established. The temperature in the furnace was ramped from room temperature to about 1000° C. over about 12 hours; maintained at about 1000° C. for about 18 hours; and ramped to room temperature over about 5 hours.

Figure 7:
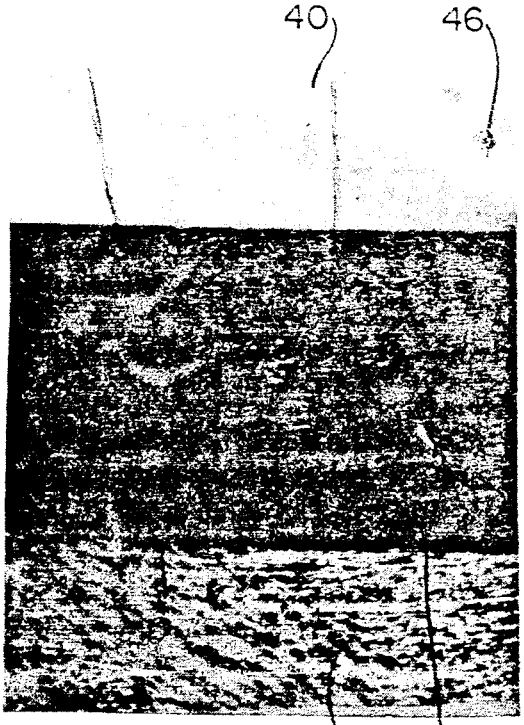
FIG. 7 is a photograph which displays a cross-section of the macrocomposite produced in Example 3.

After reaching room temperature, the setup was removed from the furnace and disassembled. FIG. 7 is a photograph which displays a cross-section of the macrocomposite (40) which was recovered from the assembly. Specifically, a body of excess matrix metal (42) is integrally attached or bonded to a metal matrix composite (44), which comprises 90 grit, 38 Alundum embedded by the matrix alloy, which is in turn integrally attached or bonded to a ceramic plate (46). Thus, this Example demonstrates that it is possible to form a multilayer macrocomposite comprising a metal matrix composite which is bonded to a ceramic piece and a solid metal piece which are on opposite sides of the metal matrix composite. Further, the present Example demonstrates that it is possible to form such a multi-layered macrocomposite in one spontaneous infiltration step.

EXAMPLE 4

The following Example demonstrates that it is possible to form a metal matrix composite body which is integrally attached to a body of solid matrix metal.

Figure 8:
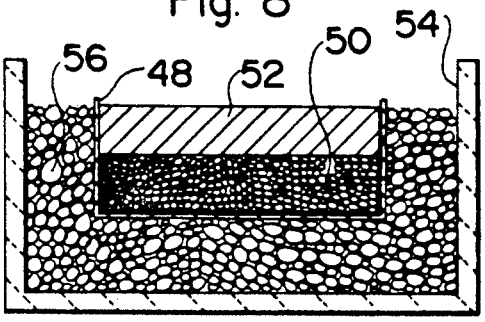
FIG. 8 is a cross-sectional view of the setup utilized to produce the macrocomposite in Example 4.

As shown in FIG. 8, a box (48) having approximate dimensions of 6½ inches by 6½ inches by 2.5 inches formed from a double layer of a 15/1000 inch thick Grade GTB graphite tape product produced by Union Carbide and sold under the trademark Grafoil® was produced by stapling appropriate size sections of the Grafoil® together and sealing the seams with a slurry made by mixing graphite powder (Grade KS-44 from Lonza Inc.) and colloidal silica (Ludox HS from du Pont). The weight ratio of graphite to colloidal silica was about ⅓.

An unground alumina filler material known as C-75 unground alumina from Alcan, was then added to the Grafoil box until the bed (50) of alumina material was approximately 1.25 inches thick. An approximately 6½ inch by 6½ inch by 1 inch ingot (52) of a matrix metal composed by weight of approximately 5% silicon, 5% Mg, 5% zinc and the balance aluminum, was placed on top of the bed (50) of alumina filler material within the Grafoil box (48). The Grafoil box (48) and its contents were then placed within a graphite refractory boat (54) on top of an approximately 1 inch thick layer of a 24 grit alumina material known as 38 Alundum and produced by Norton Co. Additional 24 grit 38 Alundum was added to the graphite boat until the surface of the bed (56) of 24 grit 38 Alundum was slightly below the top of the Grafoil box (48).

The setup, consisting of the graphite refractory boat (54) and its contents, was placed within a controlled atmosphere electric resistance heated vacuum furnace at room temperature. A high vacuum (approximately $1\times10^{-4}$ torr) was then created within the furnace and the furnace temperature was raised to about 200° C. in approximately 45 minutes. The furnace temperature was maintained at about 200° C. under vacuum conditions for approximately 2 hours before the furnace was backfilled with nitrogen gas to approximately 1 atmosphere. A continuous flow rate of about 1.5 liters/min of nitrogen gas was established within the furnace and the furnace temperature was ramped over about 5 hours to about 865° C.; held at about 865° C. for about 24 hours; and ramped to room temperature in about 3 hours.

Figure 9:
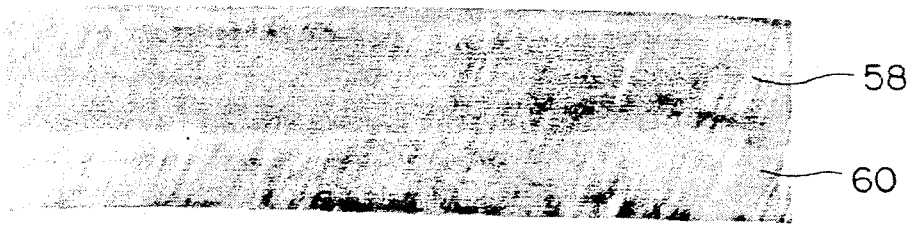
FIG. 9 is a photograph displaying a cross-section of the macrocomposite produced in Example 4.

After reaching room temperature, the setup was removed from the furnace and disassembled. FIG. 9 is a photograph which displays a cross-section of the macrocomposite recovered from the setup. Specifically, FIG. 9 displays a metal matrix composite (58) comprising C-75 unground alumina embedded by the matrix metal, which is integrally attached to a body (60) of residual matrix metal.

Thus, this Example demonstrates that it is possible to obtain a macrocomposite consisting of a metal matrix composite which is integrally bonded to a body of residual matrix metal.

EXAMPLE 5

This Example demonstrates that it is possible to produce a macrocomposite which comprises a body of excess matrix metal which is integrally attached to or bonded with a metal matrix composite which is in turn integrally attached to or bonded with a ceramic body. Specifically, the ceramic body and the body of excess matrix metal are integrally attached to or bonded with a metal matrix composite which comprises a three dimensionally interconnected ceramic structure embedded within a metal matrix.

Figure 10:
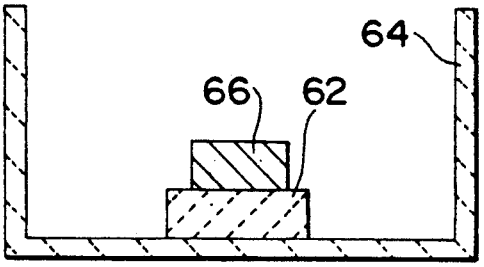
FIG. 10 is a cross-sectional view of the setup utilized to produce the macrocomposite in Example 5.

As shown in FIG. 10, an approximately 1 inch by 1.5 inch by 0.5 inch ceramic filter (62) comprised of approximately 99.5% pure aluminum oxide and containing about 45 pores per inch was obtained from High Tech Ceramics of Alfred, N.Y. The ceramic filter (62) was placed in the bottom of an alumina boat (64) and an ingot (66) of a matrix metal having approximate dimensions of 1 inch by 1 inch by ½ inch and composed by weight of about 5% silicon, about 6% zinc, about 10% magnesium, and the balance aluminum, was placed on top of the ceramic filter (62). The alumina boat (64) was a 99.7% alumina Sagger obtained from Bolt Technical Ceramics (BTC-AL-99.7%) and had approximate dimensions of 100 mm length by 45 mm width by 19 mm height by 3 mm base thickness. The setup, comprising the alumina refractory boat and its contents, was placed in a tube furnace at room temperature. The furnace door was then closed and forming gas (approximately 96% by volume nitrogen, 4% by volume hydrogen) was supplied to the furnace at a gas flow rate of about 250 cc/minute. The furnace temperature was ramped at about 150° C./hour to about 775° C.; maintained at about 775° C. for 7 hours; and then ramped down at about 200° C./hour to room temperature. Upon removal from the furnace, a macrocomposite was recovered from the setup. The metal matrix composite layer of the macrocomposite was sectioned and a photomicrograph of the microstructure was obtained. This photomicrograph is displayed as FIG. 11.

Figure 11:
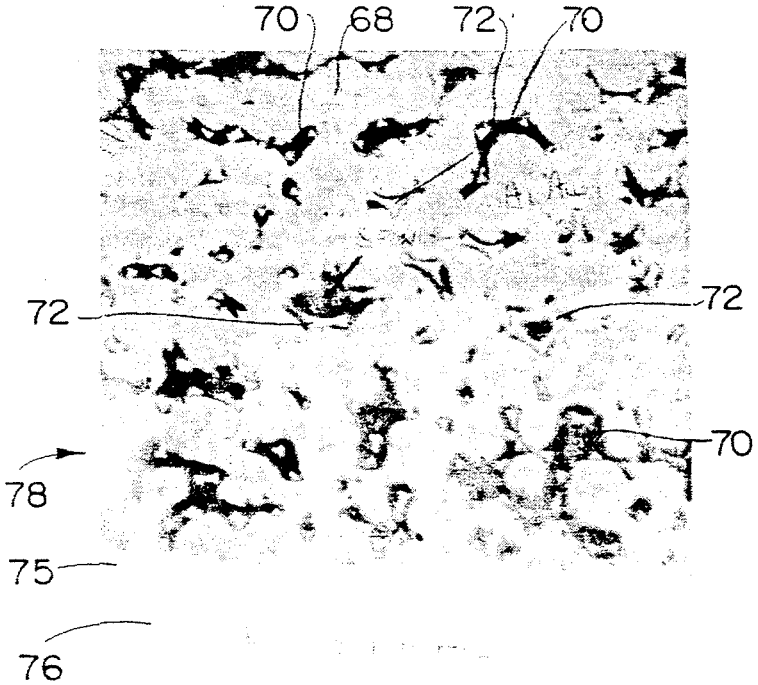
FIG. 11 is a photomicrograph of a cross-section of the macrocomposite formed in Example 5.

As shown in FIG. 11, an effective infiltration of matrix metal (68) into the porosity of the ceramic filter (70) was obtained. Moreover, as indicated by the lines labeled (72) in FIG. 11, the matrix metal infiltration was so complete that it infiltrated the porosity contained within the alumina component of the ceramic filter (70). FIG. 11 also shows the interface (75) between the bottom of the alumina boat (76) and the metal matrix composite (78). In addition, although not shown in the photograph, excess matrix metal was integrally attached or bonded to the end of the metal matrix composite which was opposite the ceramic piece, i.e., opposite the bottom of the alumina boat.

Thus, this Example demonstrates that it is possible to form a multi-layered macrocomposite which comprises a body of excess matrix metal which is integrally attached or bonded to a metal matrix composite which is in turn integrally attached or bonded to a ceramic body.

EXAMPLE 6

The following Example demonstrates that it is possible to spontaneously infiltrate a series of preforms in one step to produce a macrocomposite comprising two metal matrix composites which are bonded to opposite sides of a thin layer of matrix metal.

Two preforms, each preform having approximate measurements of 7 inches by 7 inches by 0.5 inch, were sediment cast from a mixture of a 220 grit alumina material known by the trade name 38 Alundum® and produced by Norton Co., and colloidal alumina (Nyacol AL-20). The approximate weight ratio of the colloidal alumina to the 220 grit 38 Alundum was 70/30.

Figure 12:
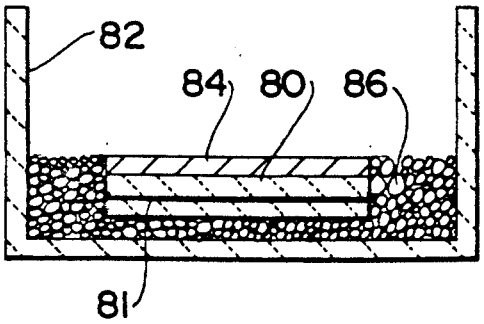
FIG. 12 is a cross-sectional view of the setup utilized to produce the macrocomposite in Example 6.

After the preforms had dried and set, a thin (approximately 1/64 inch thick) layer of colloidal alumina paste (Nyacol AL-20) was painted on a surface of each of the two preforms. The two painted surfaces were then brought into contact so as to sandwich the colloidal alumina between the two preforms. As shown in FIG. 12, this assembly of preforms (80), including the interfacial layer (81) of colloidal alumina, was then placed within a refractory boat (82) on top of an approximately ½ inch thick layer of Grade HCT titanium diboride produced by Union Carbide. An ingot (84) of matrix metal having approximate dimensions of 7 inches by 7 inches by ½ inch and composed by weight of approximately 5% silicon, 5% zinc, 7% Mg, 2% copper and the balance aluminum was placed on top of the assembly of preforms (80). Additional Grade HCT titanium diboride was then added to the refractory boat (82) until the surface of the bed (86) of titanium diboride was approximately level with the upper surface of the matrix metal ingot (84).

The setup, consisting of the refractory boat (82) and its contents, was then placed within a controlled atmosphere electric resistance heated vacuum furnace at room temperature. A high vacuum (approximately $1\times10^{-4}$ torr) was then achieved within the furnace and the furnace temperature was raised to about 200° C. in about 45 minutes. The furnace temperature was maintained at about 200° C. under vacuum conditions for approximately 2 hours. After this initial two hour heating period, the furnace was backfilled with nitrogen gas to approximately 1 atmosphere and the temperature was raised to about 865° C. in approximately 5 hours; maintained at about 865° C. for about 18 hours; and then ramped to room temperature in about 5 hours.

Figure 13:
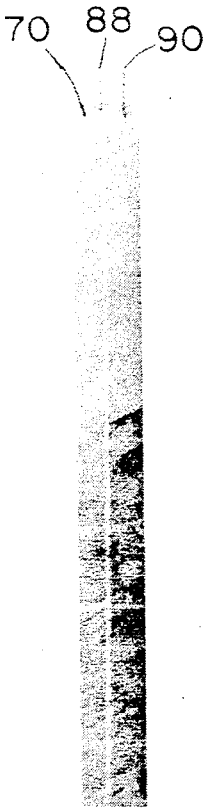
FIG. 13 is a photograph of a cross-section of the macrocomposite formed in Example 6.

After reaching room temperature, the setup was removed from the furnace and disassembled. FIG. 13 is a photograph of a crosssection of the macrocomposite recovered from the setup. Specifically, a layer of matrix metal (88) is sandwiched between two metal matrix composites (90) each comprising 220 grit 38 Alundum (and residue from the Nyacol colloidal alumina) embedded by matrix metal. The layer of matrix metal (88) is integrally attached or bonded to each of the metal matrix composites (90), thus forming a macrocomposite.

Thus, this Example demonstrates that it is possible to form, in a single spontaneous infiltration step, a macrocomposite comprising two metal matrix composites which are integrally attached or bonded by a thin layer of matrix metal.

What is claimed is:

1. A method for producing a macrocomposite comprising:

juxtaposing a mass of filler or preform relative to a body of matrix metal such that at least a portion of said matrix metal, when molten, will spontaneously infiltrate said mass of filler or preform to form a metal matrix composite body;

juxtaposing a second or additional body relative to said mass of filler or preform such that when said matrix metal spontaneously infiltrates said mass of filler or preform the matrix metal comes into contact with at least a portion of said second or additional body;

heating said matrix metal to a temperature above the melting point of said matrix metal but below the melting point of said filler or preform and below the melting point of said second or additional body;

providing an infiltrating atmosphere;

spontaneously infiltrating at least a portion of said mass of filler or preform with at least a portion of said matrix metal to form a metal matrix composite body;

continuing said spontaneous infiltration until said matrix metal comes into contact with at least a portion of said second or additional body; and cooling said matrix metal to a temperature below the melting point of said matrix metal to form a body of excess matrix metal which is integrally attached to or bonded with a metal matrix composite body which is integrally attached or bonded to said second or additional body, said second or additional body having a greater coefficient of thermal expansion than said metal matrix composite body so that said second or additional body retains at least a portion of said metal matrix composite body under compression.

2. The method of claim 1, wherein the volume of said metal matrix composite body is less than the volume of said body of excess matrix metal.

3. The method of claim 2, wherein said metal matrix composite body comprises a thin layer on the surface of said body of excess matrix metal.

4. The method of claim 1, wherein the volume of said metal matrix composite body is greater than the volume of said body of excess matrix metal.

5. The method of claim 4, wherein said body of excess matrix metal comprises a thin layer on the surface of said metal matrix composite body.

6. The method of claim 1, wherein said second or additional body comprises at least one body selected from the group consisting of ceramic bodies, ceramic matrix composite bodies, metal bodies and metal matrix composite bodies.

7. The method of claim 6, wherein said mass of filler or preform comprises an assemblage of at least two preforms.

8. The method of claim 1, wherein said second or additional body comprises an interconnected or bonded assemblage of at least two bodies selected from the group consisting of ceramic bodies, ceramic matrix composite bodies, metal bodies and metal matrix composite bodies.

9. The method of claim 8, wherein said mass of filler or preform comprises an assemblage of at least two preforms.

10. A method for producing a macrocomposite comprising:

juxtaposing a mass of filler or preform relative to a body of matrix metal such that at least a portion of said matrix metal, when molten, will spontaneously infiltrate said mass of filler or preform to form a metal matrix composite body;

providing said mass of filler or preform with a support means which will enable said mass of filler or preform to maintain a three dimensionally interconnected geometry and sufficient porosity to permit the spontaneous infiltration of said matrix metal at a temperature where both said matrix metal and said filler or preform are molten;

heating said matrix metal to a temperature above the melting point of both said matrix metal and said filler or preform but below the temperature at which said support means loses its ability to maintain said three-dimensionally interconnected geometry and said sufficient porosity;

providing an infiltrating atmosphere;

spontaneously infiltrating at least a portion of said mass of filler or preform with at least a portion of said matrix metal to form a metal matrix composite body; and cooling said matrix metal and said filler or preform to a temperature below the melting point of both said matrix metal and said filler or preform to form a body of excess matrix metal which is integrally attached to or bonded with said metal matrix composite body.

11. The method of claim 10, wherein a second or additional body is juxtaposed relative to said mass of filler or preform such that when said matrix metal spontaneously infiltrates said mass of filler or preform the matrix metal comes into contact with said second or additional body and, upon cooling said matrix metal and said filler or preform to a temperature below their respective melting points, the metal matrix composite body is integrally attached or bonded to both said body of excess matrix metal and said second or additional body.

12. A method for producing a macrocomposite comprising:

juxtaposing a mass of filler or preform relative to a body of matrix metal such that said matrix metal, when molten, will spontaneously infiltrate said mass of filler or preform to form a metal matrix composite body;

juxtaposing at least one second or additional body relative to said mass of filler or preform such that when said matrix metal spontaneously infiltrates said mass of filler or preform the matrix metal comes into contact with at least a portion of said at least one second or additional body;

heating said matrix metal to a temperature above the melting point of said matrix metal but below the melting point of said filler or preform;

providing an infiltrating atmosphere;

spontaneously infiltrating at least a portion of said mass of filler or preform with said matrix metal to form a metal matrix composite body;

continuing said spontaneous infiltration until said matrix metal comes into contact with at least a portion of said at least one second or additional body; and cooling said matrix metal to a temperature below its melting point to form a macrocomposite comprising said metal matrix composite body which is integrally attached to or bonded with said at least one second or additional body.

13. The method of claim 12, wherein said infiltrating atmosphere communicates with at least one of the matrix metal and the filler or preform for at least a portion of the period of infiltration.

14. The method of claim 12, further comprising the step of supplying at least one of an infiltration enhancer precursor and an infiltration enhancer to at least one of the matrix metal, the filler or preform, and the infiltrating atmosphere.

15. The method of claim 14, wherein said at least one of the infiltration enhancer precursor and infiltration enhancer is supplied from an external source.

16. The method of claim 14, wherein during infiltration, the infiltration enhancer precursor volatilizes.

17. The method of claim 16, wherein the volatilized infiltration enhancer precursor reacts to form a reaction product in at least a portion of the filler or preform.

18. The method of claim 17, wherein said reaction product is formed as a coating on at least a portion of said filler.

19. The method of claim 12, wherein the filler comprises at least one ceramic material.

20. The method of claim 12, wherein the infiltrating atmosphere comprises an atmosphere selected from the group consisting of oxygen and nitrogen.

21. A method for producing a macrocomposite comprising:

juxtaposing a mass of filler or preform relative to a body of matrix metal such that said matrix metal, when molten, will spontaneously infiltrate said mass of filler or preform to form a metal matrix composite body;

juxtaposing at least one second or additional body relative to said mass of filler or preform such that when said matrix metal spontaneously infiltrates said mass of filler or preform the matrix metal comes into contact with at least a portion of said at least one second or additional body;

providing an infiltration enhancer precursor;

spontaneously infiltrating at least a portion of said mass of filler or preform with said matrix metal to form a metal matrix composite body;

continuing said spontaneous infiltration until said matrix metal comes into contact with at least a portion of said at least one second or additional body; and cooling said matrix metal to a temperature below the melting point of said matrix metal to form a macrocomposite comprising said metal matrix composite body which is integrally attached to or bonded with said at least one second or additional body.

22. The method of claims 11, 12 or 21, wherein said second or additional body has a greater coefficient of thermal expansion than said metal matrix composite body and, upon cooling the matrix metal to a temperature below its melting point, the second or additional body places at least a portion of the metal matrix composite body under compression.

23. The method of claims 11, 12 or 21, wherein said metal matrix composite body has a greater coefficient of thermal expansion than said second or additional body and, upon cooling the matrix metal to a temperature below its melting point, the metal matrix composite body places at least a portion of the second or additional body under compression.

24. The method of claims 1, 11, 12 or 21, wherein one or both of said metal matrix composite body and said second or additional body comprises notches, holes, slots, or any other surface irregularities which are matched with a corresponding inversely shaped surface irregularity on the surface to which the metal matrix composite body or the second or additional body is to be integrally attached or bonded and wherein said matching surface irregularities create a mechanical attachment or bond in addition to any attachment or bond which may exist between said metal matrix composite body and said second or additional body.

25. The method of claims 12 or 21, wherein the infiltration occurs within defined barrier means.

26. The method of claim 25, wherein the barrier comprises a material selected from the group consisting of carbon, graphite and titanium diboride.

27. The method of claims 12 or 21, wherein the filler comprises at least one material selected from the group consisting of powders, flakes, platelets, microspheres, whiskers, bubbles, fibers, particulates, fiber mats, chopped fibers, spheres, pellets, tubules and refractory cloths.

28. The method of claims 14 or 21, wherein the matrix metal comprises aluminum, the infiltrating atmosphere comprises nitrogen and the infiltration enhancer precursor comprises at least one material selected from the group consisting of magnesium, strontium and calcium.

29. The method of claims 14 or 21, wherein the matrix metal comprises aluminum, the infiltrating atmosphere comprises oxygen and the infiltration enhancer precursor comprises zinc.

30. The method of claim 21, further comprising providing an infiltrating atmosphere.

31. The method of claim 30, wherein said infiltration enhancer precursor is supplied to at least one of the matrix metal, the filler or preform and the infiltrating atmosphere.

32. The method of claims 14 or 30, wherein the matrix metal comprises aluminum, the infiltrating atmosphere comprises nitrogen and the infiltration enhancer precursor comprises magnesium.

33. The method of claim 21, wherein said infiltration enhancer precursor is supplied to at least one of said matrix metal and said filler or preform.

34. The method of claim 12, wherein said infiltration enhancer precursor is supplied to both of said matrix metal and said filler or preform.

35. The method of claims 12 or 21, wherein said metal matrix composite body comprises a thin layer on the surface of said second or additional body.

36. The method of claims 12 or 21, wherein said second or additional body comprises a thin layer on the surface of said metal matrix composite body.

37. The method of claims 12 or 21, wherein said second or additional body comprises at least one body selected from the group consisting of ceramic bodies, ceramic matrix composite bodies, metal bodies, and metal matrix composite bodies.

38. The method for producing a macrocomposite comprising:

juxtaposing a mass of filler or preform relative to a body of matrix metal such that at least a portion of said matrix metal, when molten, will spontaneously infiltrate said mass of filler or preform to form a metal matrix composite body;

juxtaposing a second or additional body relative to said mass of filler or preform such that when said matrix metal spontaneously infiltrates said mass of filler or preform the matrix metal comes into contact with at least a portion of said second or additional body;

heating said matrix metal to a temperature above the melting point of said matrix metal but below the melting point of said filler or preform and below the melting point of said second or additional body;

providing an infiltrating atmosphere;

spontaneously infiltrating at least a portion of said mass of filler or preform with at least a portion of said matrix metal to form a metal matrix composite body;

continuing said spontaneous infiltration until said matrix metal comes into contact with said at least a portion of said second or additional body; and cooling said matrix metal to a temperature below the melting point of said matrix metal to form a body of excess matrix metal which is integrally attached to or bonded with a metal matrix composite body which is integrally attached or bonded to said second or additional body, said metal matrix composite body having a greater coefficient of thermal expansion than said second or additional body so that said metal matrix composite body retains at least a portion of said second or additional body under compression.

* * * * *

UNITED STATES PATENT AND TRADEMARK OFFICE

CERTIFICATE OF CORRECTION

PATENT NO. : 5,040,588

DATED : August 20, 1991

INVENTOR(S) : Newkirk et al.

It is certified that error appears in the above-indentified patent and that said Letters Patent is hereby corrected as shown below:

Column 1, line 20: change "infiltation" to --infiltration--.
Column 3, line 64: change "cold- pressed" to --cold-pressed--.
Column 7, line 6: change "macro composite" to --macrocomposite--.
Column 9, line 57: change "Non-Oxidizinq" to --Non-Oxidizing--.
Column 10, line 56: change ""Infiltratinq" to --"Infiltrating--.
Column 14, line 12: change "macro composite" to --macrocomposite--.
Column 15, line 14: after "such" insert --as--.
Column 20, line 31: delete "o".
Column 25, line 25: change "calcified" to --calcined--.
Column 30, line 19: change "crosssection" to --cross-section--.

Signed and Sealed this

Fourteenth Day of December, 1993

Bruce Lehman

*Attest:*

BRUCE LEHMAN

*Attesting Officer*

*Commissioner of Patents and Trademarks*